US007089782B2

(12) United States Patent
Lin et al.

(10) Patent No.: US 7,089,782 B2
(45) Date of Patent: Aug. 15, 2006

(54) POLISHING HEAD TEST STATION

(75) Inventors: Jian Lin, Milpitas, CA (US); Volker Geissler, Dresden (DE); Jens-Michael Wendler, Dippoldiswalde (DE)

(73) Assignee: Applied Materials, Inc., Santa Clara, CA (US)

( * ) Notice: Subject to any disclaimer, the term of this patent is extended or adjusted under 35 U.S.C. 154(b) by 230 days.

(21) Appl. No.: 10/339,172

(22) Filed: Jan. 9, 2003

(65) Prior Publication Data

US 2004/0134287 A1 Jul. 15, 2004

(51) Int. Cl.
*G01M 3/02* (2006.01)

(52) U.S. Cl. ..... 73/37
(58) Field of Classification Search ..... 73/37, 73/807; 451/8, 9
See application file for complete search history.

(56) References Cited

U.S. PATENT DOCUMENTS

| | | | | |
|---|---|---|---|---|
| 5,035,087 | A | 7/1991 | Nishiguchi et al. | |
| 5,342,068 | A | 8/1994 | Large | |
| 5,486,129 | A * | 1/1996 | Sandhu et al. | 451/5 |
| 5,660,581 | A | 8/1997 | Shin et al. | |
| 5,664,987 | A | 9/1997 | Renteln | |
| 5,676,590 | A | 10/1997 | Hiraoka | |
| 5,741,171 | A | 4/1998 | Sarfaty et al. | |

(Continued)

FOREIGN PATENT DOCUMENTS

| | | |
|---|---|---|
| DE | 3713155 | 11/1988 |
| DE | 10123386 | 11/2002 |
| EP | 0879678 | 11/1998 |
| JP | 8094508 | 4/1996 |
| JP | 2001298008 | 10/2001 |
| JP | 2001310253 | 11/2001 |

*Primary Examiner*—Max Noori
(74) *Attorney, Agent, or Firm*—Konrad Raynes Victor & Mann, LLP

(57) ABSTRACT

A test station for testing polishing heads for planarizing semiconductor wafers and other substrates has a head positioning control system which can precisely position the polishing head at one of many electronically controlled positions above the test station platform. The test station may also include a lateral carriage assembly which supports the polishing head above a base plate of the station and permits the polishing head to be moved in a gliding motion above the surface of the test station test wafer. A sensor senses when the carriage of the assembly is moved from a load position. In response, the test station controller causes a vertical actuator to lift the head mount in the vertical or Z direction. In this position, there is sufficient clearance for the polishing head being carried by the carriage to slide under the head mount and into position for mounting to the head adapter. The carriage includes a carriage plate, the top surface of which defines a generally disk segment shaped recess which is sized and shaped to receive the bottom of a polishing head of a first size, such as a polishing head adapted to hold 300 mm semiconductor wafers for polishing, for example. The test station includes an adapter plate which may be placed onto the carriage plate of the carriage instead of a polishing head. The adapter plate has a recess which is sized to receive a different sized polishing head. A wafer chuck can chuck test wafers of different sizes, such as 200 mm wafers and 300 mm wafers, for example and includes a plate which defines a first set of annular-shaped grooves in a first area which is a central disk-shaped area. A second set of annular-shaped grooves are positioned in a second area which is annular shaped and surrounds the central area. The test station has two independent vacuum lines coupled to the first and second sets of grooves respectively, which draw vacuum pressure through the grooves to draw a test wafer down and chuck the test wafer in place on the wafer chuck.

49 Claims, 18 Drawing Sheets

U.S. PATENT DOCUMENTS 5,759,918 A 6/1998 Hoshizaki et al.
6,053,688 A 4/2000 Cheng
6,066,266 A 5/2000 Osugi et al.
6,113,480 A 9/2000 Hu et al.
6,164,633 A 12/2000 Mulligan et al.
6,220,936 B1 4/2001 Quek
6,251,215 B1 6/2001 Zuniga et al.
6,257,564 B1 7/2001 Avneri et al.
6,272,902 B1 * 8/2001 Chen et al. ..... 73/37
6,379,221 B1 4/2002 Kennedy et al.
6,402,595 B1 6/2002 Fiesser
6,428,389 B1 8/2002 Sato et al.
6,459,945 B1 10/2002 Singh et al.
6,549,279 B1 * 4/2003 Adams et al. ..... 356/326
6,592,429 B1 * 7/2003 Campbell ..... 451/8
2001/0012751 A1 8/2001 Boyd et al.
2002/0016131 A1 2/2002 Sandhu et al.
2002/0024174 A1 2/2002 Gaal et al.
2002/0137436 A1 9/2002 Kistler et al.

* cited by examiner

POLISHING HEAD TEST STATION

BACKGROUND

The present invention relates generally to chemical mechanical polishing of substrates, and more particularly to a test station for testing the polishing head and other equipment for a chemical mechanical polishing of semiconductor substrates.

Integrated circuits are typically formed on substrates, particularly silicon wafers, by the sequential deposition of conductive, semiconductive or insulative layers. After each layer is deposited, it is often etched to create circuitry features. As a series of layers are sequentially deposited and etched, the outer or uppermost surface of the substrate, i.e., the exposed surface of the substrate, can become increasingly non-planar. This non-planar surface may present problems in the photolithographic steps of the integrated circuit fabrication process. Therefore, there is often a need to periodically planarize the substrate surface.

Chemical mechanical polishing (CMP) is one accepted method of planarization. This planarization method typically includes mounting a substrate on a carrier or polishing head. The exposed surface of the substrate is placed against a rotating polishing pad. The polishing pad may be either a "standard" or a fixed-abrasive pad. A standard polishing pad has a durable roughened surface, whereas a fixed-abrasive pad typically has abrasive particles held in a containment media. The polishing head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The polishing head can undergo periodic maintenance in which the head is disassembled, worn parts replaced and then reassembled. Prior to returning the head to polishing additional wafers, the refurbished head can be tested at a test station to determine whether the head operates properly before using it on expensive wafers or other semiconductor substrates.

SUMMARY

A test station for testing a chemical and mechanical polishing head has a continuous head positioning control system which can precisely position the polishing head at one of many controlled positions above the test station platform. In the illustrated embodiment, the head position control system includes an electronically controlled linear actuator which can position a polishing head mounted in a mount at one end of a mount arm, at a precise vertical position selected by a controller relative to a test surface or test wafer support surface of the test station. This vertical position is measured along a Z-axis which is orthogonal to the test surface which supports a test wafer for testing with the polishing head.

In one embodiment, the linear actuator includes a servo motor assembly and a vertical carriage assembly which guides the mount arm and restricts the movement of the mount arm and hence the head to linear, nonrotational movements along the Z-axis. The servo motor of the assembly is preferably of the type that has an output shaft which can be positioned to specific angular positions by sending the servo a coded signal. In general, the servo motor will maintain the angular position of the motor output shaft as long as the coded signal exists on the input line. When the coded input signal changes, the angular position of the shaft changes to a new angular position corresponding to the new coded input signal. Other types of precision motors such as stepper motors may be used as well. Other actuators may include a pressure cylinder which may be used to position the head at a controlled position in response to selective applications of different pressures to the cylinder.

The ability of the head test station to precisely position the polishing head at a precise, electronically controlled position can significantly facilitate testing of the polishing head. For example, a wafer loss sensor may be tested when the polishing head is located at a particular desired height above a test wafer.

A head test station in accordance with another aspect includes a lateral carriage assembly which can significantly facilitate loading and mounting a polishing head into the test station for testing. The lateral carriage assembly supports the polishing head above a base plate of the station and permits the polishing head to be moved in a gliding motion above the surface of the test station test wafer. The carriage assembly includes a carriage which slides between a load position at which the polishing head may be loaded onto the carriage and a mount position at which the polishing head may be mounted onto the test station mount. In this manner, heavy polishing heads may be readily moved into position by the carriage for mounting to a head mount for testing while reducing the chances for damage to the test wafer or the polishing head which could be caused by inadvertent dropping of the polishing head onto the test wafer.

In another aspect of the present invention, a sensor senses when the carriage is moved from the load position. In response, the test station controller causes a vertical actuator to lift the head mount in the vertical or Z direction. In this position, there is sufficient clearance for the polishing head being carried by the carriage to slide under the head mount and into position for mounting to the head adapter.

With the polishing head mounted to the head mount, the carriage may be withdrawn back to the load or standby position. As the carriage approaches the sensor indicating that the carriage is in or is close to the load/standby position, the vertical actuator lowers the head mount and the polishing head mounted to the adapter, down to the test position.

In another aspect, the carriage includes a carriage plate, the top surface of which defines a generally disk segment shaped recess which is sized and shaped to receive the bottom of a polishing head of a first size, such as a polishing head adapted to hold 300 mm semiconductor wafers for polishing, for example. The polishing head is loaded into the carriage recess when the carriage is in the load position. As the carriage is moved to the head mount position, the carriage plate recess inhibits sliding of the polishing head relative to the plate and facilitates aligning the polishing head with the head mount in the mount position.

In accordance with yet another aspect of the present invention, a test station may readily accommodate testing a variety of polishing heads having different exterior dimensions and includes an adapter plate which may be placed onto the carriage plate of the carriage instead of a polishing head. The adapter plate has a recess which is sized to receive a different sized polishing head.

In accordance with still another aspect, a test station may include a wafer chuck which can chuck test wafers of different sizes, such as 200 mm wafers and 300 mm wafers, for example. In the illustrated embodiment, the wafer chuck includes a plate which defines a first set of annular-shaped grooves in a first area which is a central disk-shaped area. A second set of annular-shaped grooves are positioned in a second area which is annular shaped and surrounds the central area. The test station has two independent vacuum lines coupled to the first and second sets of grooves respectively, which draw vacuum pressure through the grooves to draw a test wafer down and chuck the test wafer in place on the wafer chuck.

To chuck a smaller test wafer such as a 200 mm wafer, for example, the test station controller opens a control valve for the central area line and closes a control valve for the outer area line so that vacuum pressure is applied to the test wafer through the grooves of the central area covered by the test wafer but not the grooves of the outer area which would be left exposed by a smaller test wafer. Conversely, to chuck a larger test wafer such as 300 mm test wafer, for example, the test station controller opens both the control valve of the central area and the control valve of the outer area so that vacuum pressure is applied to the test wafer both through the grooves of the central area and the grooves of the outer area which are both covered by a larger test wafer. It is appreciated that the number, size and shapes of the grooves and areas may vary, depending upon the particular application.

In accordance with another aspect, the test station may have pneumatic pressure, vacuum and exhaust circuits for devices other than polishing heads used in the polishing of semiconductor wafers. For example, the test station may have pneumatic circuits for testing F.I. pad conditioners as well as the chambers of various other polishing materials.

There are additional aspects to the present inventions. It should therefore be understood that the preceding is merely a brief summary of some embodiments and aspects of the present inventions. Additional embodiments and aspects of the present inventions are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

DETAILED DESCRIPTION

Figure 1:
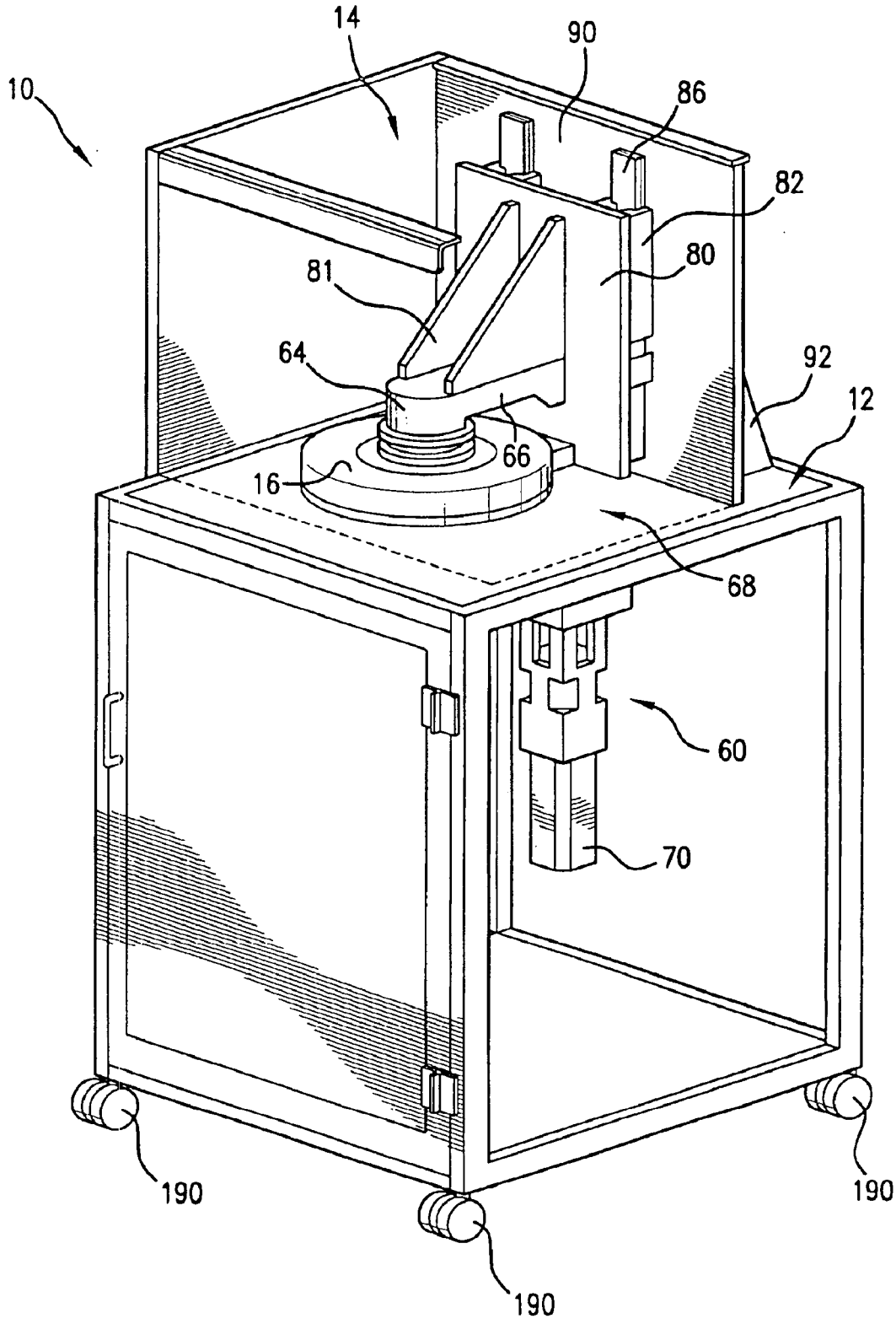
FIG. 1 is a perspective view of the polishing head test station in accordance with one embodiment of the present invention.
Figure 2:
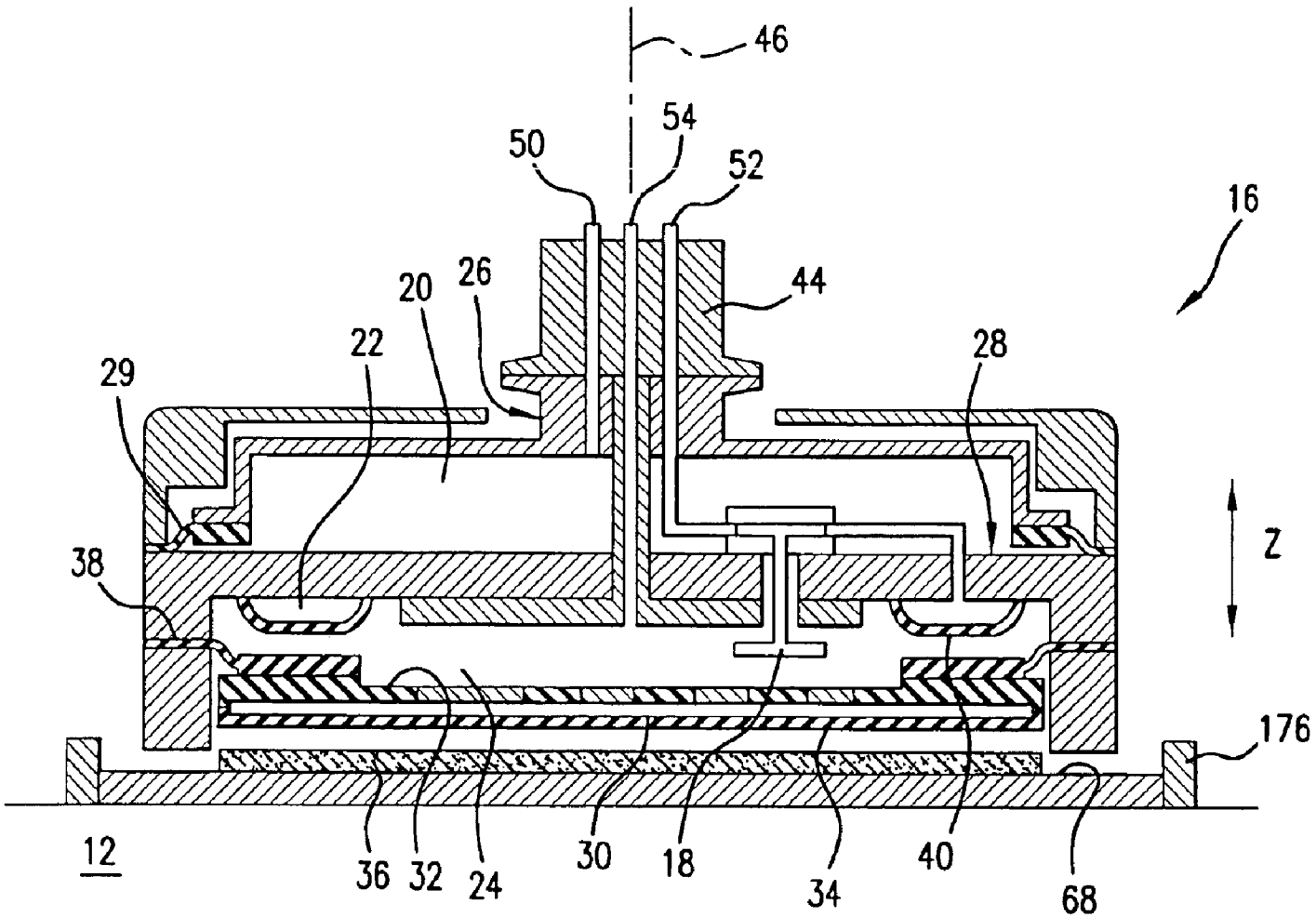
FIG. 2 is a schematic cross-sectional view of a typical polishing head.

A test station in accordance with one embodiment of the present invention is indicated generally at 10 in FIG. 1. The test station 10 includes a platform 12 which supports a head positioning control system 14 which positions a chemical and mechanical polishing head 16 above the platform 12. As will be explained in greater detail below, the head position control system 14 can precisely position the head 16 at one of many electronically controlled positions above the platform 12 as shown in FIG. 2. As a consequence, testing procedures of the head 16 are facilitated as described below. By comparison, it is believed that in prior head testing stations, the polishing head was mounted at a fixed height or was movable between two mechanically fixed heights.

FIG. 2 shows a schematic cross-sectional diagram of a typical chemical and mechanical polishing head 16. It should be appreciated that a test station in accordance with aspects of the present invention may be used to test a variety of different types of wafer or substrate polishing heads including heads for polishing 150 mm, 200 mm or 300 mm wafers.

A polishing head such as the head 16 of FIG. 2 may have several sensors which are preferably tested by the test station 10. An example of such a sensor is indicated generally at 18 and senses if the wafer has been lost. The number and type of sensors may vary from one type of polishing head to another. Other common types of head sensors include wafer presence sensors and wafer pressure sensors.

The polishing head 16 also has three pressure sealed chambers, that is, a retaining ring chamber 20, an inner tube chamber 22 and a membrane chamber 24. The test station 10 can apply various tests to the chambers to ensure proper sealing and operation. It is appreciated that the number and types of chambers may vary from head type to head type. For example, the head may have from three to eight chambers.

In the head 16 of the illustrated embodiment, the retaining ring chamber 20 is located between a housing 26 and a base 28 of the head 16. The retaining ring chamber 20 is pressurized to apply a load, i.e., a downward pressure, to the base 28 during a wafer polishing operation. A rolling diaphragm 29 flexibly couples the housing to the base 28 and permits the expansion and contraction of the retaining ring chamber 20. In this manner, the vertical position of the base 28 relative to a polishing pad is controlled by the pressure in the retaining ring chamber 20.

A flexible membrane 30 extends below a support structure 32 to provide a mounting surface 34 for the wafer or other semiconductor substrate 36 to be polished. Pressurization of the membrane chamber 24 positioned between the base 28 and support structure 32 forces flexible membrane 30 downwardly to press the substrate against the polishing pad. A flexure 38 flexibly couples the support structure 32 to the base 28 and permits the expansion and contraction of the membrane chamber 24.

Another elastic and flexible membrane 40 may be attached to a lower surface of base 28 by a clamp ring or other suitable fastener to define the inner tube chamber 22. Pressurized fluid such as air may be directed into or out of the inner tube chamber 22 and thereby control a downward pressure on support structure 32 and flexible membrane 30.

The housing 26 has a spindle 44 which can be connected to a drive shaft of the polishing system to rotate the head 16 therewith during polishing about an axis of rotation 46 which is substantially perpendicular to the surface of the polishing pad during polishing. Three pressure lines 50, 52 and 54 direct fluid such as air or nitrogen to each of the chambers 20, 22 and 24 either at a pressure above ambient (pressurized) or below ambient (vacuum pressure).

Figure 3:
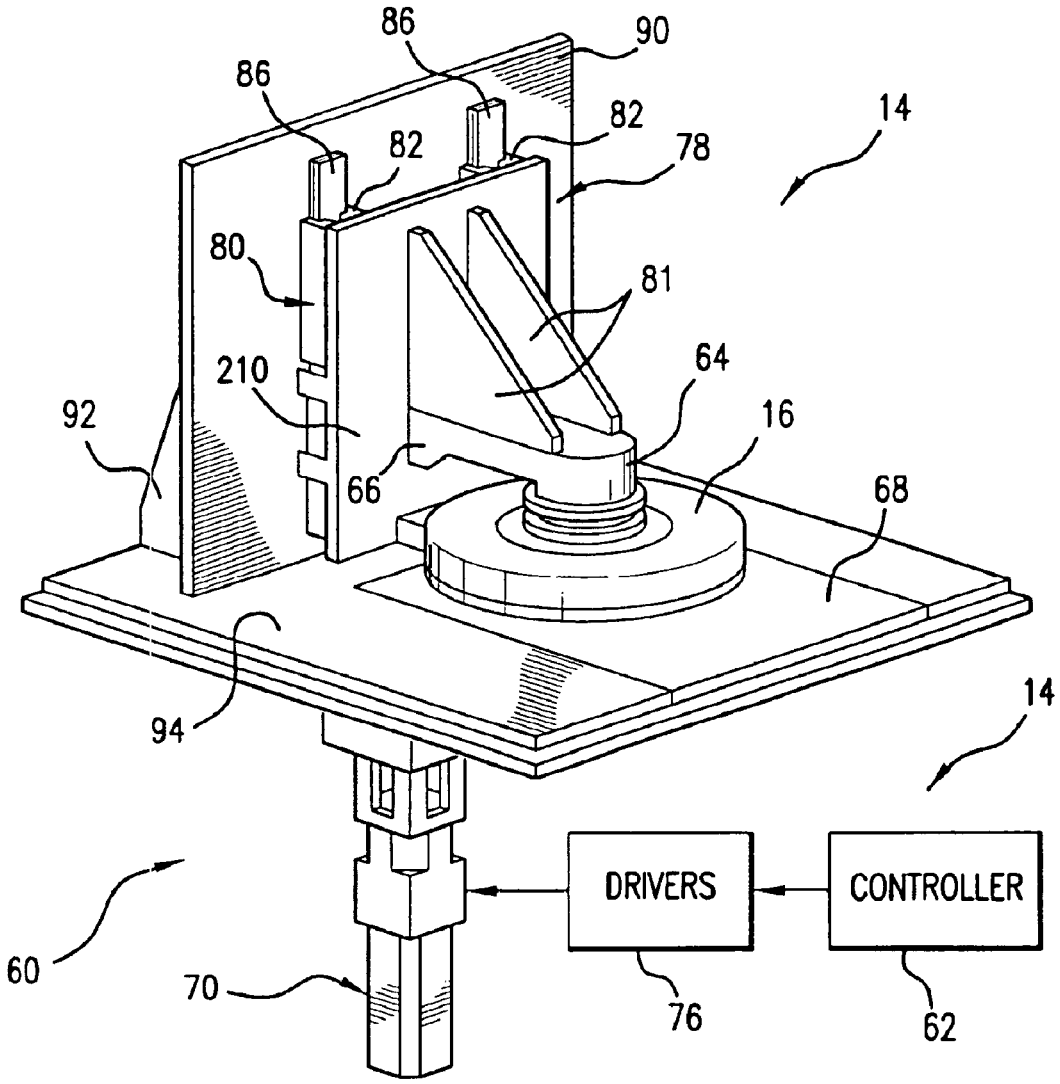
FIG. 3 is a partial perspective and schematic view of the z-axis actuator of the test station of FIG. 1.

FIG. 3 shows in greater detail, the head position control system 14 of the head test station 10 for testing polishing heads such as the polishing head 16. As shown therein, the head position control system 14 includes an electronically controlled linear actuator 60 which is controlled by a controller 62 which may be a programmed general purpose computer such as a personal computer. Alternatively, the controller 62 may comprise programmed logic arrays, distributed logic circuits or other digital or analog control circuitry. The linear actuator 60 can position a head 16 mounted in a mount 64 at one end of a mount arm 66, at a precise position selected by the controller 62. In the illustrated embodiment, the controlled precise position is the vertical displacement of the head 16 relative to a test surface or test wafer support surface 68 (FIG. 2) of the platform 12 of the test station 10. This vertical displacement is measured along a Z-axis which is orthogonal to the test surface 68 which supports a test wafer for testing with the polishing head. In this embodiment, the Z-axis is parallel to the axis 46 of rotation of the head. It is appreciated that other displacement directions may be selected for control.

Figure 4:
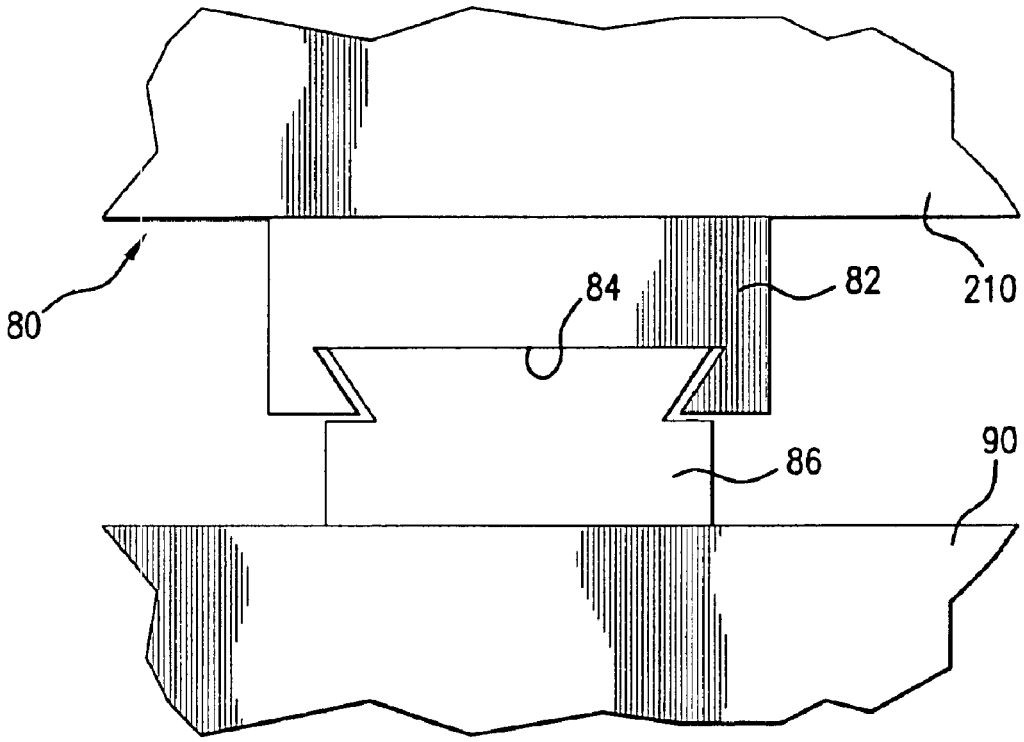
FIG. 4 is a top view of a portion of the carriage assembly of the test station of FIG. 1.

The linear actuator 60 includes a servo motor assembly 70 which is controlled by the controller 62 through suitable driver circuits 76. The output of the servo motor assembly 70 is coupled to a vertical carriage assembly 78 which guides the mount arm 66 and restricts the movement of the mount arm and hence the head 16 to linear, nonrotational movements along the Z-axis. The carriage assembly 78 includes a carriage 80 to which the mount arm 66 is mounted by a pair of braces 81. The carriage 80 has a pair of guide bars 82, each of which defines a generally trapezoidal shaped guide channel 84 (FIG. 4). Each guide channel 84 receives a complementary trapezoidal shaped guide rail 86 and is adapted to slide along that guide rail 86. The guide rails 86 of the carriage assembly are mounted on a vertical support plate 90 to guide the carriage 80 and hence the head 16 in a vertical, non-pivoting, linear movement up and down along the Z-axis. The support plate 90 is mounted by braces 92 to a horizontal support plate 94 of the platform 12. It is appreciated that other mechanical arrangements may be selected to guide the polishing head along one or more selected axes of movement.

The servo motor assembly 70, together with the driver circuits 76 are commercially available devices. For example, in the illustrated embodiment, the servo motor assembly 70 is sold by Panasonic under the model name MUMS081 750 W/100V and the driver circuits 76 are sold by LOGOSOL under the model name LS173P Driver. The servo motor of the assembly 70 is preferably of the type that has an output shaft which can be positioned to specific angular positions by sending the servo a coded signal. In general, the servo motor will maintain the angular position of the motor output shaft as long as the coded signal exists on the input line. When the coded input signal changes, the angular position of the shaft changes to a new angular position corresponding to the new coded input signal. The servo motor assembly typically includes feedback circuits including an angular position sensor to monitor the current angle of the output shaft of the servo motor. If the shaft is at the correct angle, then the motor shuts off. If the feedback circuit finds that the angle is not correct, it will turn the motor in the appropriate direction until the angle is correct.

The servo motor assembly 70 is preferably capable of being controlled to move in small, precise incremental movements or steps of 0.0360 degrees or less from one angular position associated with a particular coded input signal to the next adjacent angular position associated with a different coded input signal corresponding to a resolution of 10,000 or more per revolution. The resolution of the controlled angular movements over the full range of motion of the servo motor output shaft may vary from application to application but a general range of greater than 250 controlled positions or steps is presently preferred. The output shaft of the servo motor may be mechanically constrained to travel a maximum number of degrees such as 180 degrees, for example. The linear actuator 60 includes a suitable mechanical motion converter between the servo motor assembly 70 and the carriage assembly 78. The motion converter includes gears which convert the precise, controlled angular movements of the servo motor output shaft to precise, controlled translational movements of the carriage assembly 78 in a linear direction along the Z-axis. The actuator 60 of the illustrated embodiment has a total linear movement in excess of 60 mm over the 180 degree range of the servo motor.

Thus, for each rotational movement of 0.0360 degrees of the servo motor output shaft, the polishing head may be moved up or down a linear displacement of a certain number of microns in each step. The displacement of each step may be 10 or 13 microns, for example. Other displacements may also be used. The particular values will vary, depending upon the particular application.

To move the polishing head to a particular height above the test surface, the controller 62 can issue to the servo motor through the driver circuits 76 a digitally coded input signal such as 10010010 for example, which corresponds to a particular polishing head height such as 1.5 mm, for example, above the test surface. Thus, in this example, in response to the digitally coded input signal 10010010, the servo motor moves the head to 1.5 mm above the test surface and holds it in that position until another digitally coded input signal is received. In response to a different digitally coded input signal, such as 11110110, for example, the servo motor moves the head to a different height such as 43.93 mm, for example, above the test surface and holds it in that position. In the illustrated embodiment, the number of positions to which the servo motor can move the polishing head and hold it at that position corresponds to the resolution of the servo motor. Hence, if the servo motor has a resolution of 10,000, the servo motor can move the polishing head to any one of 10,000 height positions as selected by the controller 62 and hold it at the position selected by the controller 62.

Alternative to a servo motor, the linear actuator 60 may utilize a stepping motor. Like the servo motor, a stepper motor preferably has an output shaft capable of being controlled to move in small, precise incremental movements or steps of 0.0360 degrees or less from one angular position associated with a particular coded input signal to the next adjacent angular position associated with a different coded input signal. To move the output shaft of a stepping motor a particular number of steps such as 5 steps, for example, the controller typically sends to the stepping motor a corresponding number of coded input signals such as 5 coded input signals in this example, one coded input signal for each step taken. Thus, to move the polishing head to a particular height above the test surface, the controller 62 can issue to the stepping motor through the appropriate driver circuits, a series of digitally coded input signals such as 500 digitally coded input signals for example, to move the polishing head 500 steps to a particular polishing head height such as 1.5 mm, for example, above the test surface. Thus, in this example, in response to the series of 500 digitally coded input signals, the stepping motor steps the head to 1.5 mm above the test surface and holds it in that position until another digitally coded input signal is received. In response to another series of digitally coded input signals, the stepping motor moves the head to a different height such as 43.93 mm, for example, above the test surface and holds it in that position. In the illustrated embodiment, the number of positions to which the stepping motor can move the polishing head and hold it at that position corresponds to the resolution of the stepping motor.

The servo or stepping motors may be controlled to move smoothly in one continuous motion from one head position to another-head position such as from the 1.5 mm position to the 43.93 mm position, for example. Alternatively, the motors may be controlled to move one small step at a time, momentarily stopping at each incremental step. Also, motors having a linear output rather than a rotational output may be utilized as well. Such linear motors preferably have an output shaft capable of being controlled to move in small, precise incremental movements of 500 microns or less from one linear position associated with a particular coded input signal to the next adjacent linear position associated with a different coded input signal.

Figure 5A:
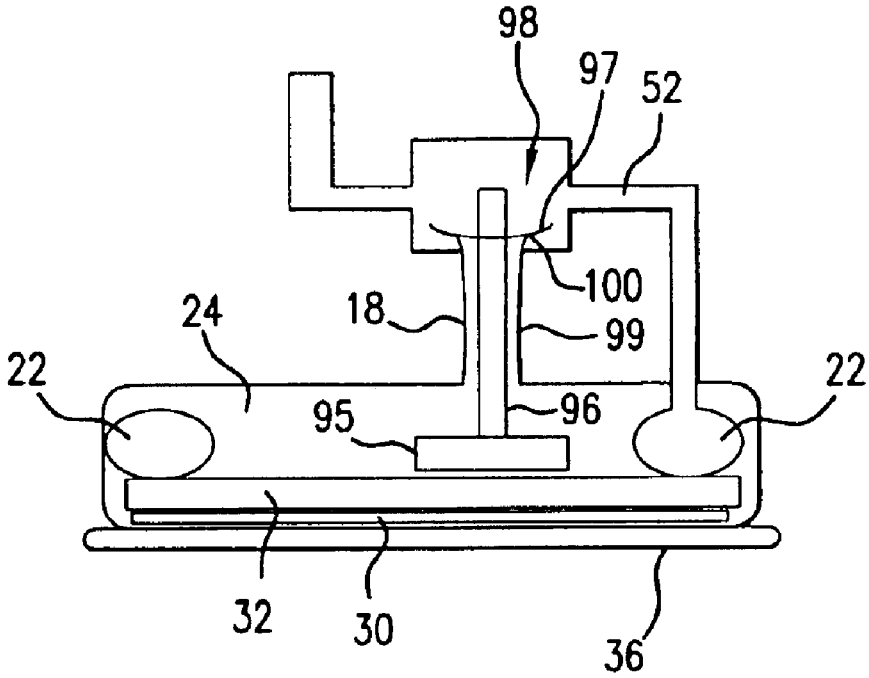
FIGS. 5*a* and 5*b* are schematic diagrams illustrating operation of a wafer loss sensor of the polishing head of FIG. 2.
Figure 5B:
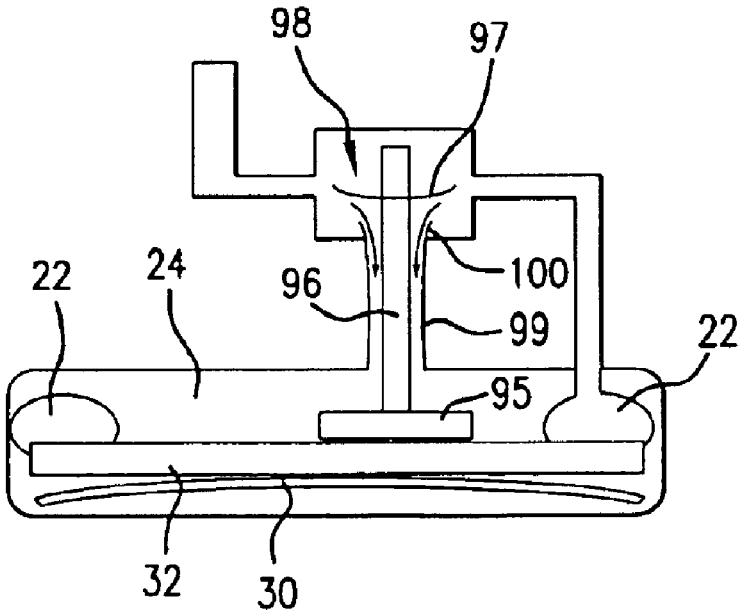

As previously mentioned, the test station 10 may be used to test a variety of sensors, chambers and other structures of a polishing head. FIGS. 5*a* and 5*b* illustrate in schematic form the operation of a typical "wafer loss" sensor 18 which provides an indication that the head is not holding a wafer. As shown in FIG. 5*a*, the wafer loss sensor 18 includes a sensor disk 95 which is connected by a shaft 96 to a valve member 97 of a valve 98. The shaft 96 moves in a conduit 99 which connects the membrane chamber 24 to the pressure line 52 of the innertube chamber 22. When a wafer 36 is held by the head 16, the wafer 36 seals the ambient pressure away from the membrane 30. In addition, the support structure 32 is displaced from the wafer loss sensor disk 95. If the inner tube chamber 22 is pressurized at a pressure of 1 psi (pounds per square inch) above ambient, for example, and the membrane chamber is at a vacuum pressure of −5 psi below ambient, for example, the valve member 97 attached to the sensor shaft 96 is sealingly seated in a valve seat 100 of the conduit 52. Consequently, the valve 98 is sealed closed and the pressures of the membrane chamber 24 and the inner tube chamber 22 remain constant, indicating that the wafer has not been "lost."

However, should the wafer drop from the head 16, ambient pressure acting on the membrane 30 drives the membrane 30 and the support structure upwardly into the membrane chamber as shown in FIG. 5*b*. The support structure 32 engages and compresses the inner tube chamber 22 causing the pressure in the inner tube chamber 22 to begin to rise as indicated at 102 in FIG. 6. As the membrane 30 and the support structure continue upwardly into the membrane chamber 24, the support structure also engages the disk 95 of the wafer loss sensor 18 as shown in FIG. 5*b*. This engagement causes the valve member 97 connected to shaft 96 of the sensor 18 to displace from the valve seat 100. As a consequence, the valve opens as indicated at 103 and the pressure in the inner tube chamber 22 begins to fall as indicated at 104 in FIG. 6 and eventually equalizes with the membrane chamber 20, indicating loss of the wafer.

Figure 7:
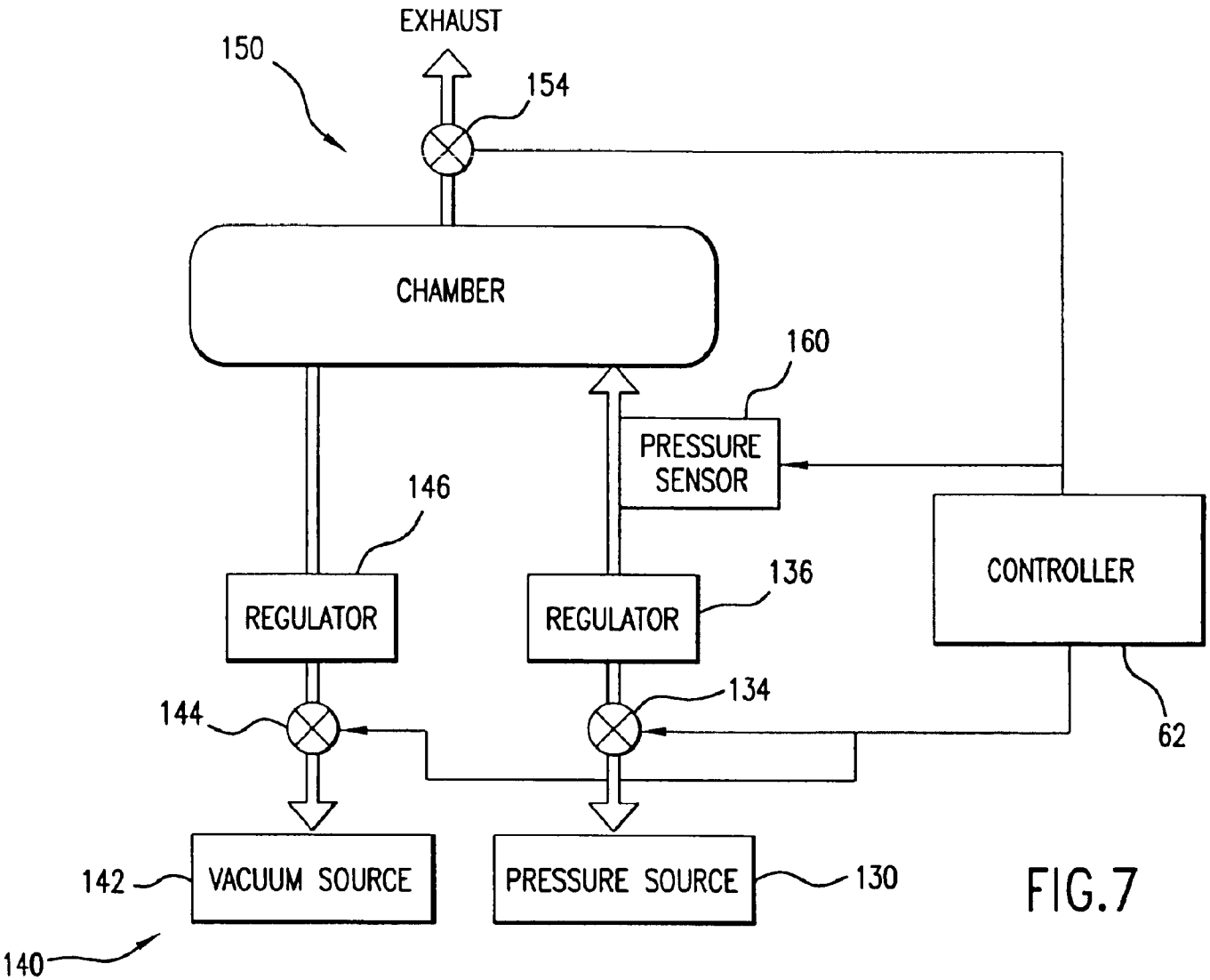
FIG. 7 is a schematic diagram of the test station pneumatic circuits associated with each pressure chamber of the polishing head of FIG. 2.

FIG. 7 is a schematic diagram of the pneumatic circuits associated with each chamber of the polishing head. In the illustrated embodiment, each chamber has a pressure circuit 130 which includes a source 132 of pressurized fluid coupled by a valve 134 and a regulator 136 to the chamber. Each chamber further has a vacuum circuit 140 which includes a source 142 of vacuum pressure (often referred to a vacuum ejector valve) coupled by a valve 144 and a regulator 146 to the chamber. A vent circuit 150 includes a valve 154 and opens the associated chamber to the ambient atmosphere.

The valves 134, 144 and 154 are controlled by the controller 62. To conserve pressure in a particular chamber, the vent valve 154, pressure valve 134 and vacuum valve 154 are closed. By closing these valves, the chamber is isolated from being further pressurized, vacuumed or vented. The pressure within the chamber may be monitored by the controller 62 through a pressure sensor 160 such as a transducer fluidically coupled to the associated chamber. If the chamber pressure drops after closing the control valves 134, 144 and 154, the presence of a leak is indicated. As previously mentioned, if the pressure in the inner tube chamber 22 follows a curve such as that shown in FIG. 6, a loss of a test wafer which had been held by the polishing head is indicated.

The test station 10 can test the chambers of the polishing head for pressure and vacuum leaks including leaks across the various chambers (cross talk). Testing includes height and time of rise as well as valve and sensor tests.

Figure 8:
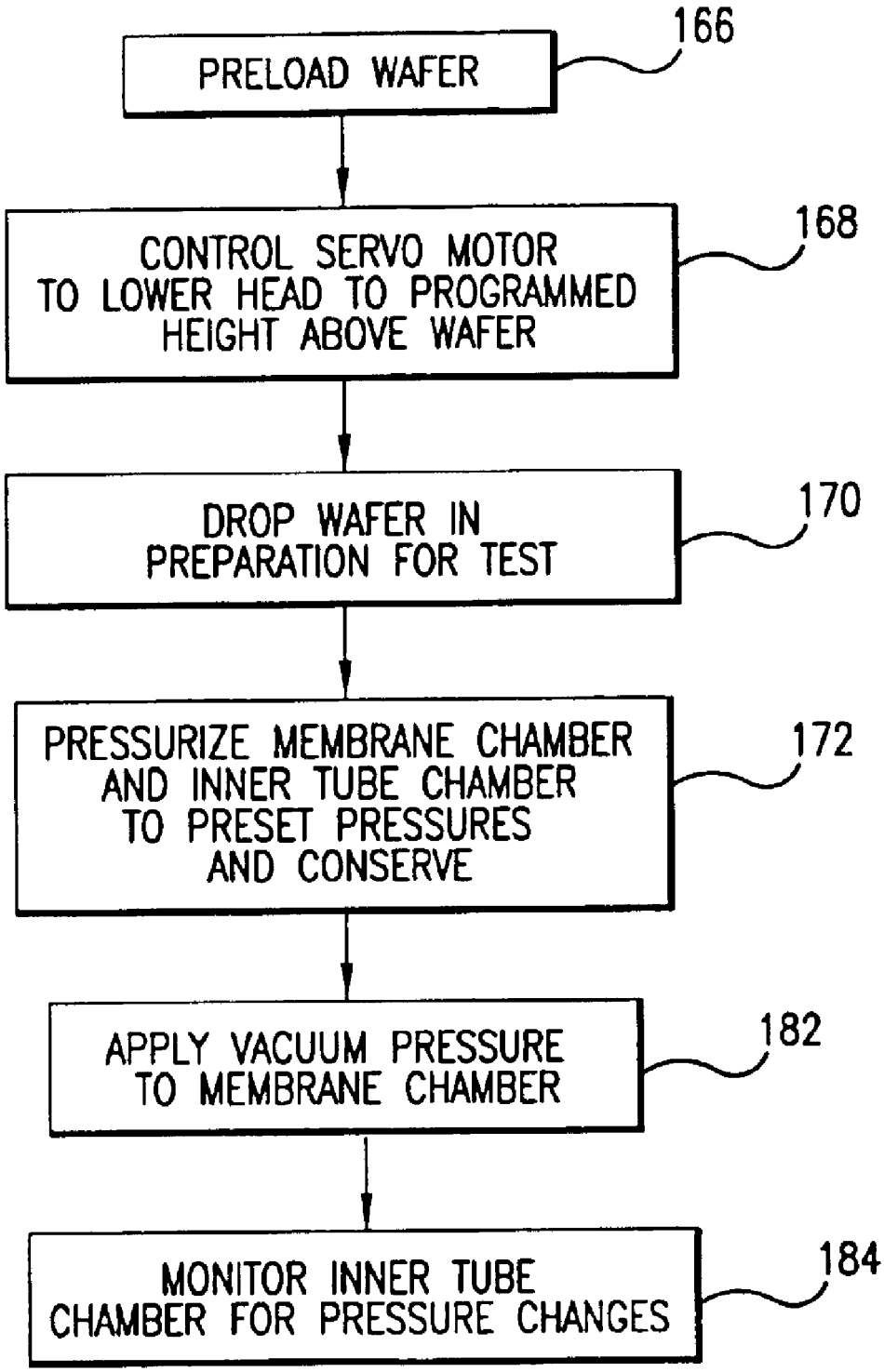
FIG. 8 is a flow chart describing a test of the wafer loss sensor a test wafer.

FIG. 8 illustrates a wafer loss sensor test utilizing a test wafer. In a first step (step 166), the test wafer is preloaded by applying a vacuum pressure to the membrane chamber while the test wafer is held by hand to the bottom of the head 16. The polishing head is then lowered (step 168) together with the preloaded test wafer to a programmed position above the test surface 68. Accordingly, the controller 62 (FIG. 3) controls the linear actuator 60 to position the head 16 and test wafer at the desired height above the test surface.

Figure 9:
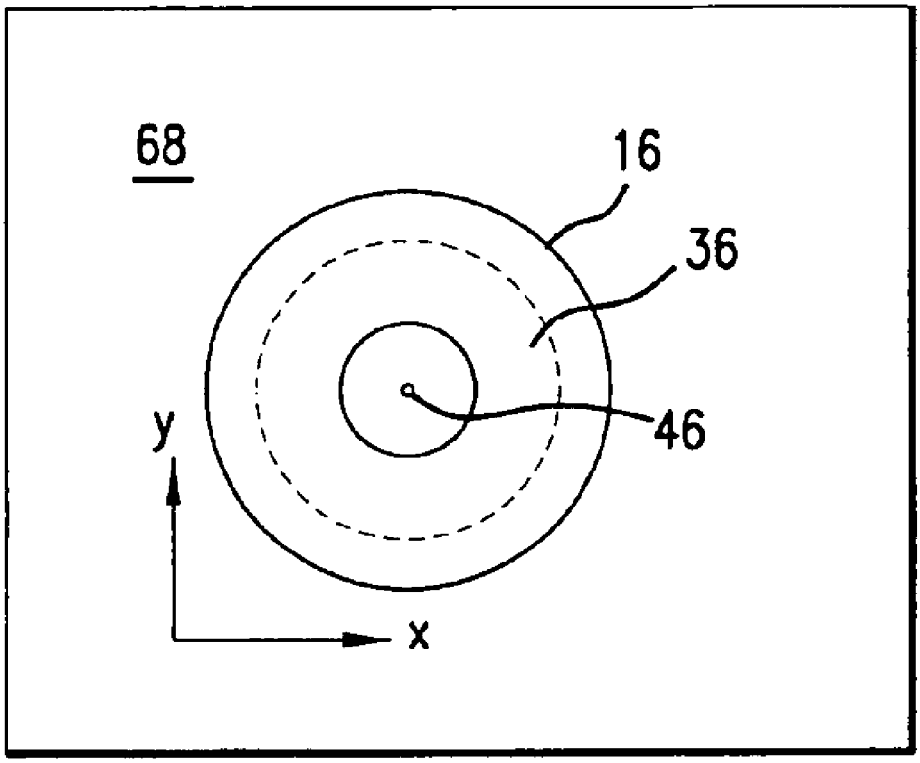
FIG. 9 is a schematic diagram illustrating the position of a test wafer on a test surface of the platform of the test station of FIG. 1 after being dropped by the polishing head onto the test surface.

The test wafer is then dropped (step 170) in preparation for the actual wafer loss sensor test. Because the height of the polishing head may be controlled very precisely, the distance that the test wafer drops onto the test surface 68 can be carefully controlled as well. In the illustrated embodiment, it is preferred that the polishing head be displaced above the top surface of the test wafer after the test wafer is dropped by the polishing head by a distance of 1.5 mm. As a consequence, when the test wafer is dropped, it has been found that the horizontal position (that is, the position along the X-axis and Y-axis (FIG. 9) parallel to the test surface of the platform) of the dropped test wafer on the platform test surface prior to initiating the wafer loss sensor test may be more easily controlled.

The controller 62 then causes the head 16 to begin the process of loading the test wafer onto the polishing head. As set forth above, in the illustrated embodiment, it is preferred that the polishing head be displaced above the top surface of the test wafer prior to loading the test wafer by a precisely controlled distance such as 1.5 mm, for example. At this distance, the membrane chamber 24 may be pressurized (step 172) to cause the head membrane 30 to become inflated prior to actually loading the wafer. As the head membrane 30 inflates, it engages the top surface of the test wafer and expresses away air pockets which may otherwise become trapped between the membrane 30 and the wafer top surface.

In the illustrated embodiment, it is preferred that the test wafer be wet for preloading and loading onto the polishing head. Accordingly, surrounding the test surface 68 of the test station platform 12 is an upstanding wall 176 which contains the wetting fluid for the test wafer. A wetted top surface of the test wafer facilitates removal of the air pockets between the membrane 30 and the test wafer top surface prior to preloading the test wafer.

To load the test wafer, the inner tube chamber 24 is also pressurized (step 172) to apply pressure to push the perimeter of the membrane 30 against the perimeter of the test wafer. The pressure in the inner tube chamber is then conserved at that pressure to test for leaks in the inner tube chamber as set forth above. If the pressure in the inner tube chamber remains steady at the preset pressurized level, a proper sealing of the inner tube chamber is indicated. In the illustrated embodiment, it is preferred that the inner tube chamber be pressurized to a level of 1 psi above ambient for the wafer loss sensor test. Other pressures in a range of 0–3 psi may also be used. The particular values will vary, depending upon the particular application.

Once maintenance of the pressure in the inner tube chamber 22 has been confirmed at the preset value, and air pockets between the membrane 30 and the wafer top surface expressed away, a vacuum pressure is applied (step 182) to the membrane chamber 24 to finish loading the test wafer. In the illustrated embodiment, it is preferred that the membrane chamber be vacuum pressurized to a level of −5 psi below ambient for the wafer loss sensor test. Other pressures in a range of −2 to −7 psi below ambient may also be used. The particular values will vary, depending upon the particular application.

If the wafer is properly loaded in a manner similar to that shown in FIG.

Sag and the wafer loss sensor has been properly installed and operates properly, the wafer loss sensor will not be actuated and the pressure in the inner tube chamber 22 should remain substantially constant as monitored (step 184) by the controller 62.

Figure 6:
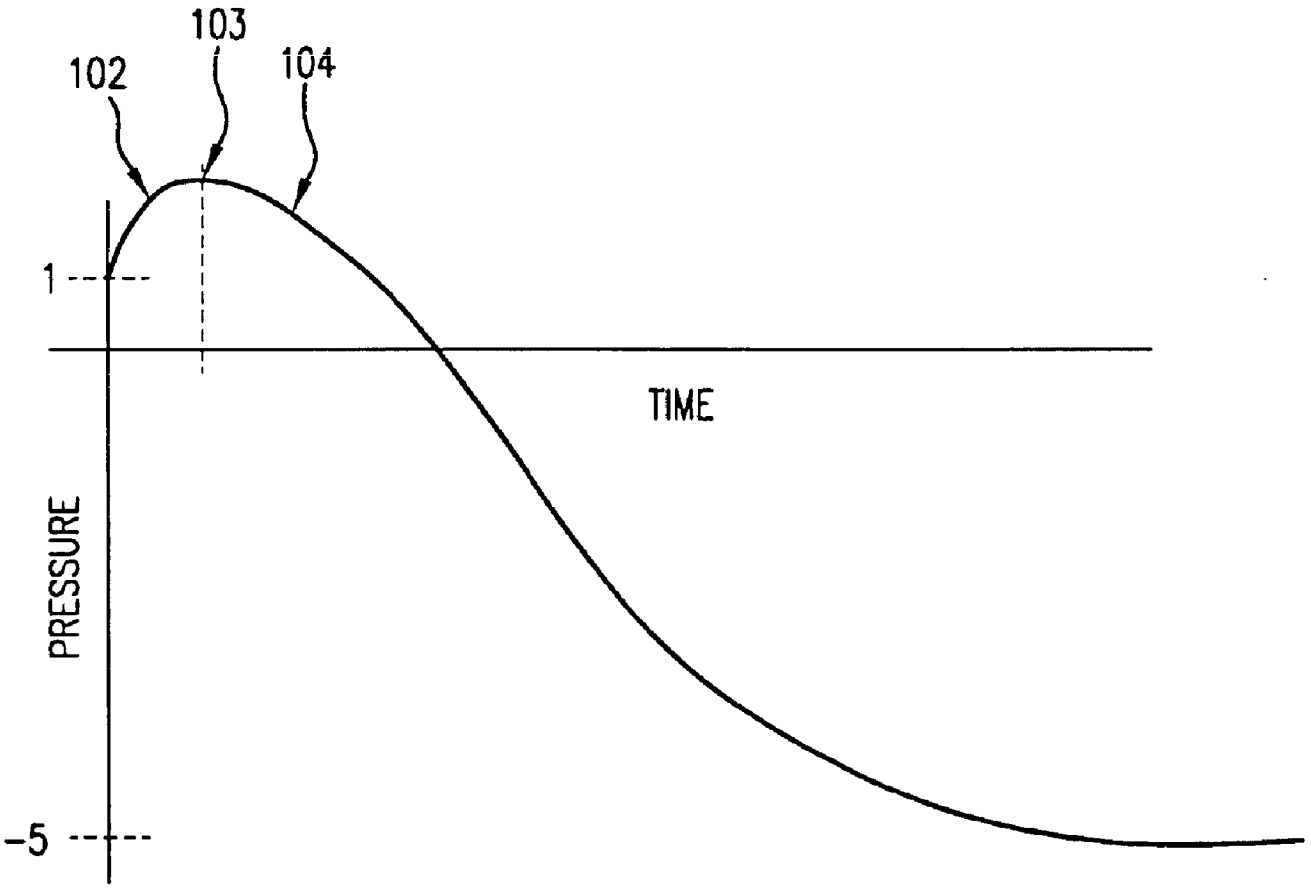
FIG. 6 is a graph illustrating pressure changes in the inner tube chamber of the polishing head during operation of the wafer loss sensor as indicated in FIGS. 5*a* and 5*b*.

On the other hand, if the wafer is not properly picked up or is dropped, the membrane 30 will be drawn into the membrane chamber 24 causing the support structure 32 to engage the inner tube chamber and the wafer loss sensor 18 as shown in FIG. 5*b*. Consequently, the pressure in the inner tube chamber 22 will initially rise as the support structure engages the inner tube chamber 22 as shown in FIG. 6 and then the pressure in the inner tube chamber will fall as the wafer loss sensor opens the valve 86 between the inner tube chamber 22 and the membrane chamber 24, indicating to the controller 62 that the wafer has been lost.

As previously mentioned, the ability of the head test station 10 to precisely position the polishing head at a precise, electronically controlled position can significantly facilitate testing of the polishing head. For example, in the wafer loss sensor test with a test wafer as described above, if the polishing head is positioned too close to the test wafer prior to loading the wafer, it is believed that the membrane 30 and support structure 32 can be driven up into the membrane chamber 24, causing the wafer loss sensor 18 to be improperly actuated. Conversely, if the polishing head is positioned too far from the test wafer prior to loading the wafer, the test wafer may not be properly picked up. Hence, vacuum pressure applied to the membrane chamber 24 to pick up the wafer can instead cause the membrane 30 and support structure 32 to be withdrawn into the membrane chamber 24, again resulting in improper actuation of the wafer loss sensor 18. A vertical position of the polishing head spaced within a range of 1–2 mm above the test surface is believed appropriate for many such applications. Other distances may also be used. The particular values will vary, depending upon the particular application.

Because of the many positions to which the head may be programmed to move, the head test station in effect provides continuous control over the movement of the head. The test position and load position of the head may be defined for many different types of heads. Any differences in the size of the heads including differences in thickness may be readily accommodated by programming the actuator control to move the head to the optimum positions for that particular head type.

Referring again to FIG. 1, the platform 12 has a set of wheels or rollers 190 which permit the test station to be readily rolled from one site to another within the fabrication facility for testing polishing heads. This can be particularly useful where the facility has more several polishing systems which utilize different sized heads.

FIGS. 10*a*–11*b* illustrate a head test station 200 in accordance with an alternative embodiment of the present invention. The test station 200 includes a lateral carriage assembly 202 which significantly facilitates loading and mounting a polishing head 203 into the test station for testing. The lateral carriage assembly 202 supports the polishing head 203 above the base plate 204 of the test station 200 and permits the polishing head to be moved in a gliding motion above the surface of the test station base plate. The carriage assembly 202 includes a carriage 206 (FIGS. 10*a*–12) which slides between a load position (FIG. 10*a*) at which the polishing head 203 may be loaded onto the carriage 206, and a mount position (FIG. 10*b*) at which the polishing head may be mounted onto the test station mount or head adapter 208 as indicated in FIG. 11*a*. The carriage 206 includes a carriage plate 210, the top surface of which defines a generally disk segment shaped recess 212 (FIG. 12) which is sized and shaped to receive the circular-shaped bottom of a polishing head of a first size, such as a polishing head 203 adapted to hold 300 mm semiconductor wafers for polishing, for example. The polishing head is loaded into the carriage recess 212 when the carriage is in the load position illustrated in FIG. 10*a*. As the carriage is moved to the head mount position (FIGS. 10*b*, 11*a*), the carriage plate recess 212 inhibits sliding of the polishing head relative to the plate 210 and facilitates aligning the polishing head with the head mount 208 in the mount position.

Figure 11A:
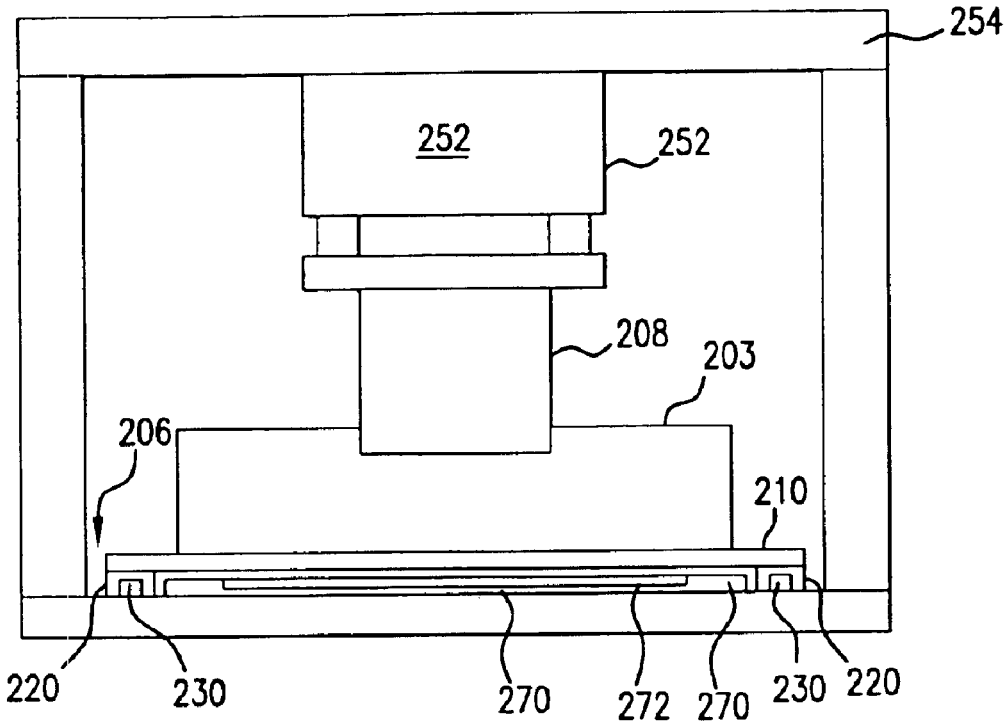
FIG. 11*a* is a front schematic view of the test station of FIG. 10*b*.
Figure 11B:
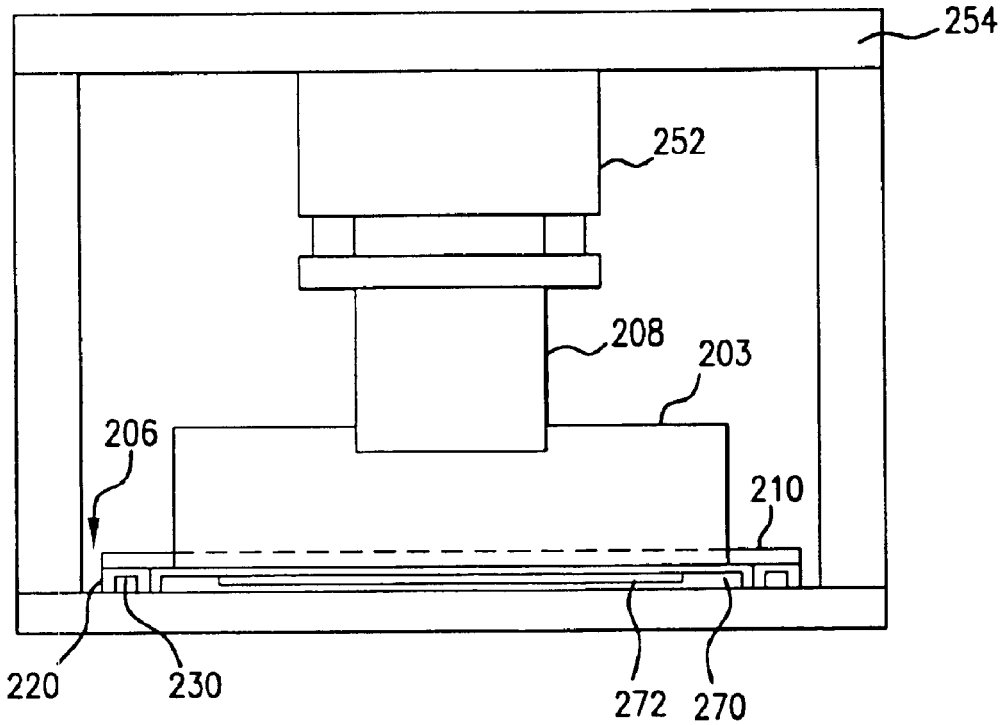
FIG. 11*b* is a front schematic view of the test station of FIG. 10*c*.
Figure 12:
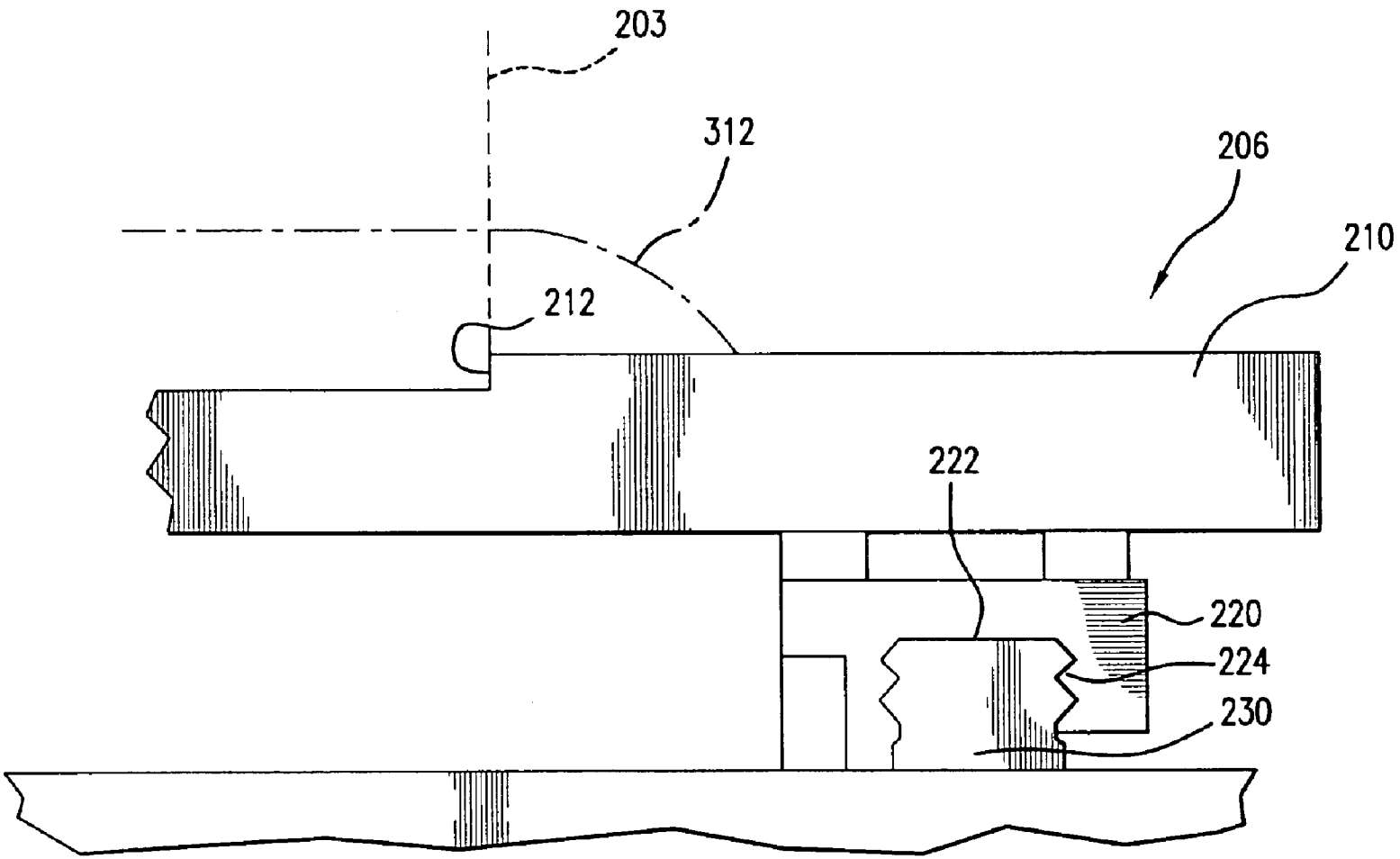
FIG. 12 is a front view of the lateral carriage assembly of the test station of FIG. 10.

As best seen in FIGS. 11*a*–12, the lateral carriage 206 has a pair of lateral guide bars 220, each of which defines a guide channel 222 (FIG. 12) which has a plurality of grooves 224 along the length of each side of the channel 222. Each guide channel 222 receives a complementary shaped grooved guide rail 230 and is adapted to slide along that guide rail 230. The guide bars 220 and guide rails 230 guide the carriage 206 and restricts the movement of the carriage and hence the head 203 to linear, nonrotational movements along the Y-axis. The guide rails 230 of the carriage assembly are mounted on the platform base plate 204 to guide the carriage 206 and hence the head 203 in a horizontal, non-pivoting, linear movement forward and back along the Y-axis between the load and mount positions. It is appreciated that other mechanical arrangements may be selected to guide the polishing head along one or more selected axes of movement.

When the carriage 206 and polishing head 203 are moved to the head mount position, the polishing head 203 is positioned below a head adapter 208 to which it is mounted as shown in FIG. 11*a*. The head adapter 208 is coupled by a vertical actuator 252 to a support frame 254 of the test station 200. In the illustrated embodiment, the actuator 252 includes a pneumatic cylinder 256 which is controlled by a controller 260 (FIG. 16) which may be a laptop computer or other control device. A sensor 262 senses when the carriage 206 is moved from the load position. In response, the controller 260 causes the actuator 252 to lift the head adapter 208 in the vertical or Z direction to a mount position shown in FIG. 11*a*. In this position, there is sufficient clearance for the polishing head 203 being carried by the carriage 206 to slide under the head adapter 250 and into position for mounting to the head adapter. The sensor 262 of the illustrated embodiment is an inductive type proximity sensor. It is appreciated that other types of sensors may be used.

Figure 10A:
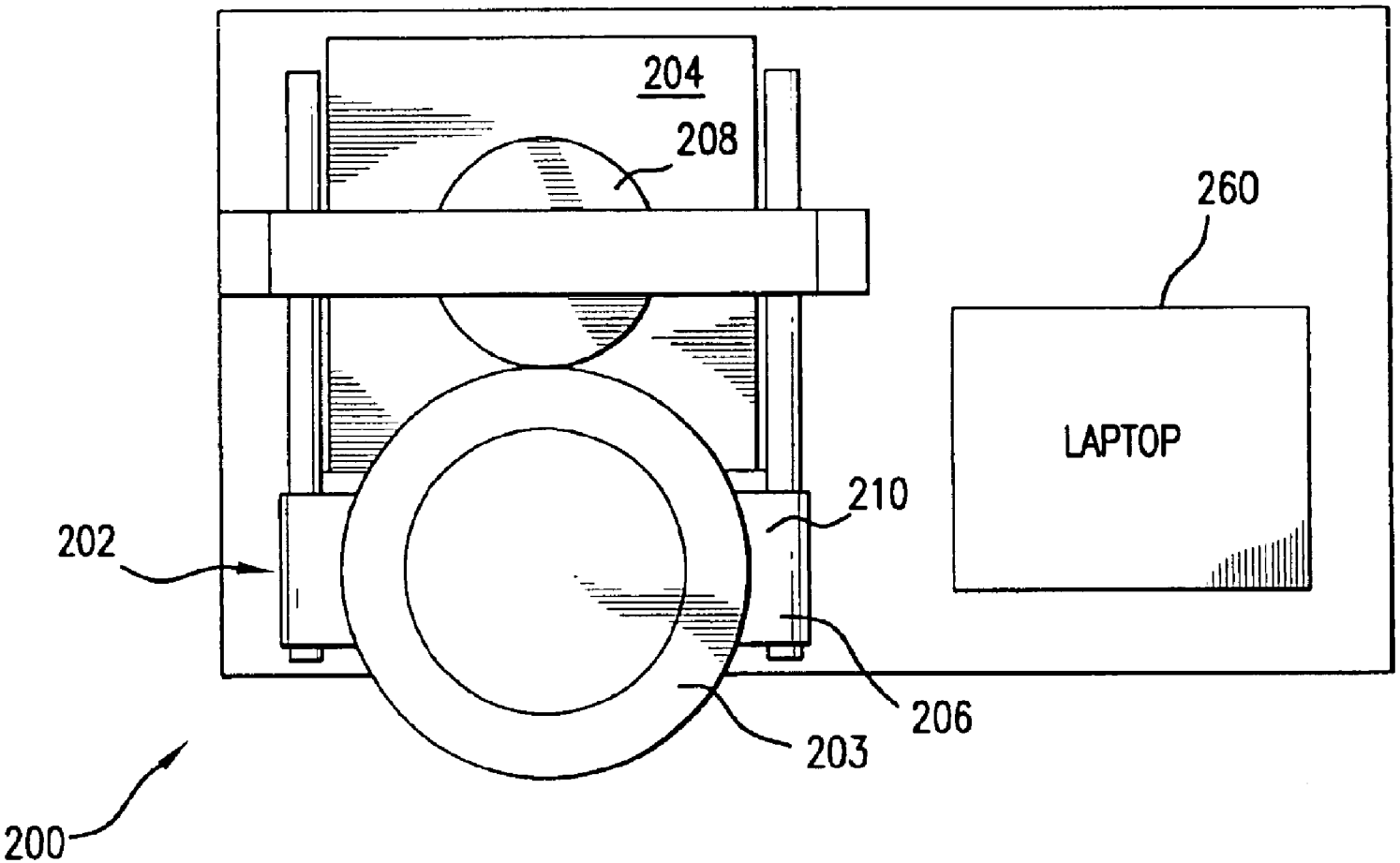
FIG. 10*a* is a top schematic view of a test station in accordance with an alternative embodiment, showing a carriage in a load position.
Figure 10B:
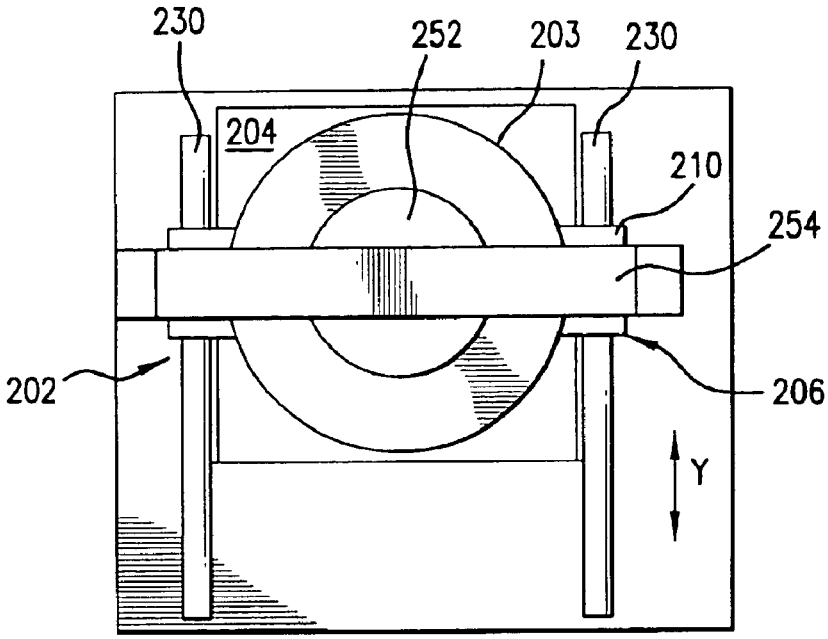
FIG. 10*b* is a top schematic view of the test station of FIG. 10*a* showing the carriage in a mount position.
Figure 10C:
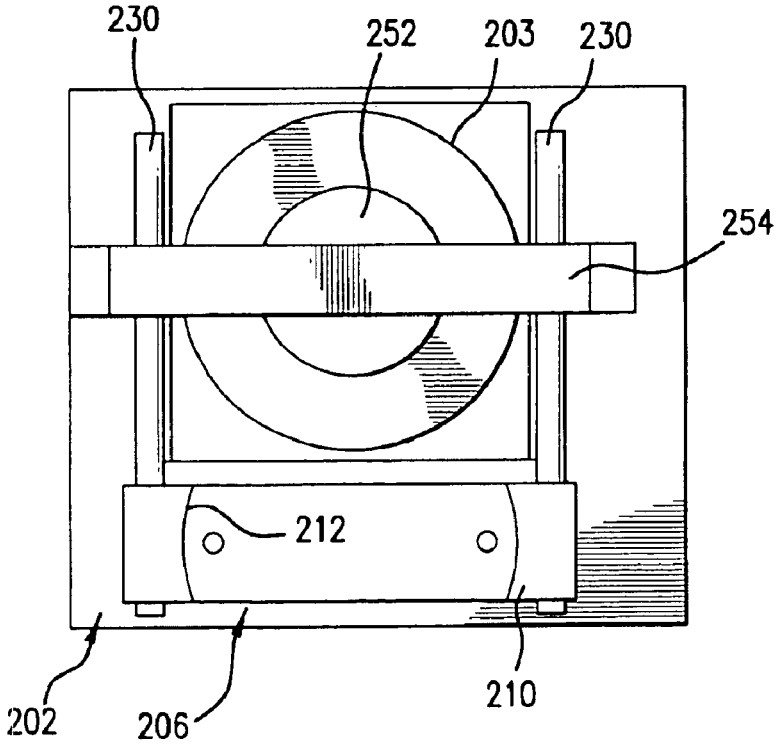
FIG. 10*c* is a top schematic view of the test station of FIG. 10*a* showing the carriage in a standby position.

With the polishing head mounted to the head adapter 250, the carriage 206 may be withdrawn back to the load or standby position as shown in FIG. 10*c*. As the carriage 206 approaches the sensor 262 indicating that the carriage 206 is in or is close to the load/standby position, the actuator 252 lowers the head adapter 208 and the polishing head 203 mounted to the adapter, down to the test position as shown in FIGS. 10*c* and 11*b*. In this position, the polishing head 203 is positioned close to a wafer chuck 270 which chucks a test wafer 272. The operation of the polishing head is tested in this position in conjunction with the wafer chuck 270 which is described in greater detail below. In the embodiment of FIGS. 11*a* and 11*b*, the two positions of the head adapter actuated by the pressure cylinder are defined by mechanical stops. However, it is appreciated that a pressure cylinder may be used to position the head adapter at pneumatically controlled positions intermediate the mechanical stop positions in response to selective applications of different pressures to the cylinder.

The guide bars 220 and guide rails 230 are sized to provide sufficient spacing between the carriage 206 and the test wafer 272 and wafer chuck 270 supported by the platform base plate 204, to permit the carriage plate 210 to pass over the test wafer 272 as the polishing head is moved into the mount position below the head adapter. In this manner, heavy polishing heads may be readily moved into position by the carriage 206 for mounting to a head adapter for testing while reducing the chances for damage to the polishing head or the test wafer which could be caused by inadvertent dropping of the polishing head onto the test wafer.

Figure 13A:
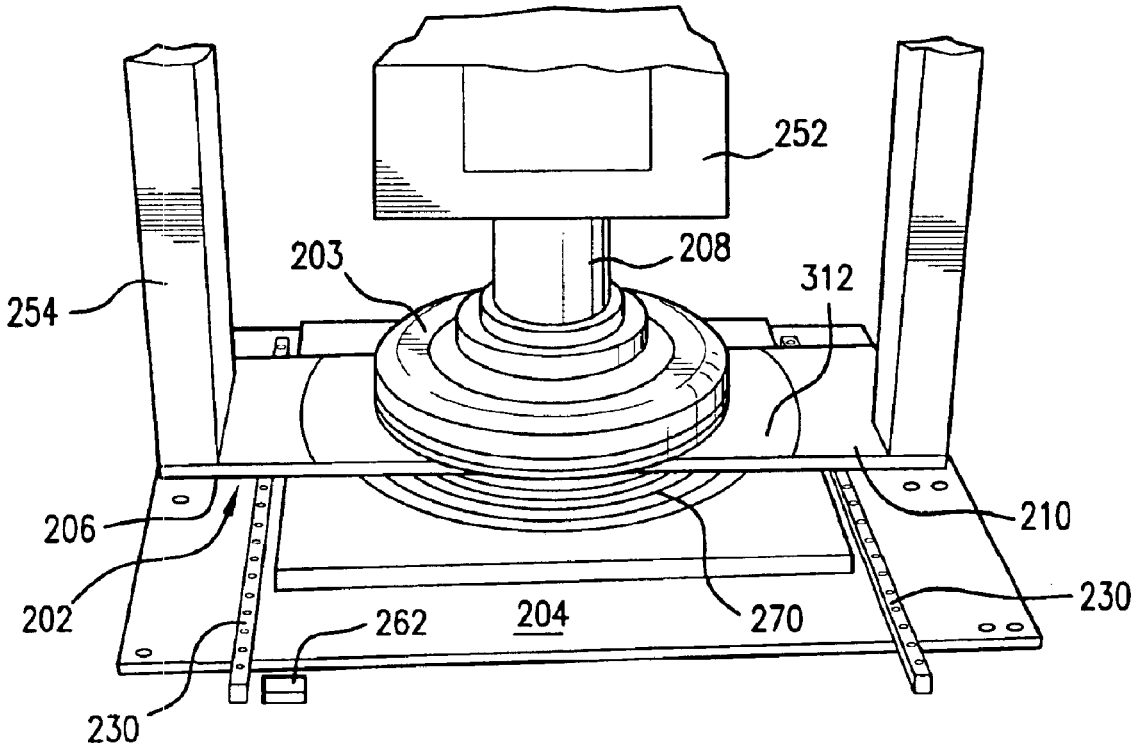
FIG. 13*a* is a perspective view illustrating the carriage assembly in the mount position.
Figure 13B:
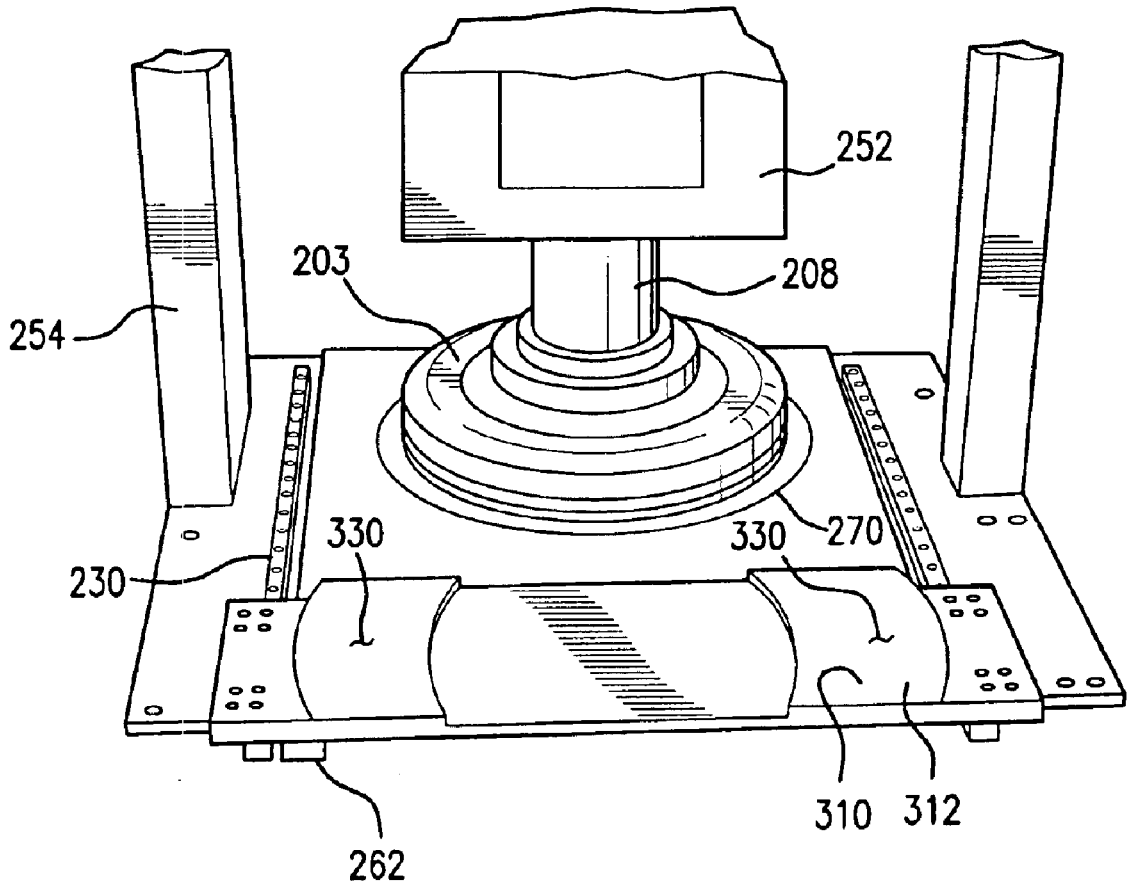
FIG. 13*b* is a perspective view illustrating the carriage assembly in the standby position.
Figure 14:
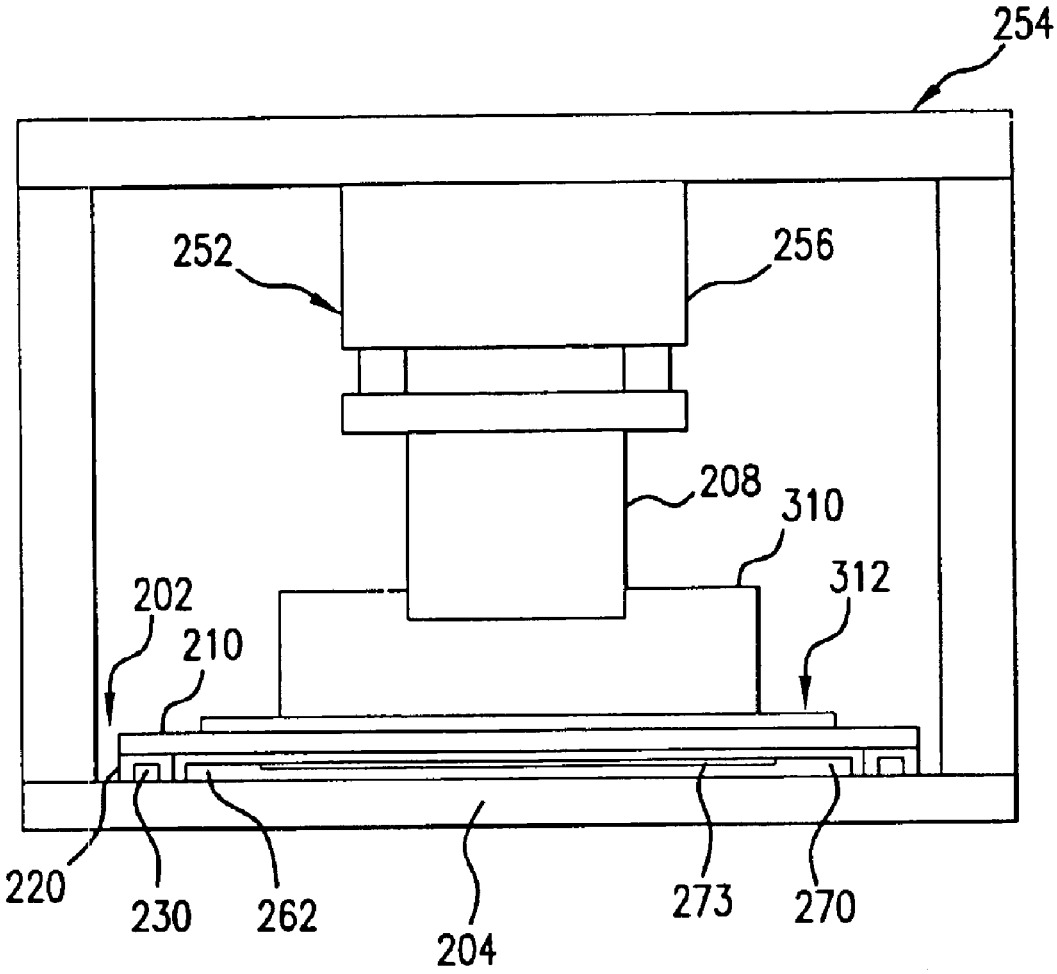
FIG. 14 is a front schematic view of the test station of FIG. 10 shown with an adapter plate.
Figure 15A:
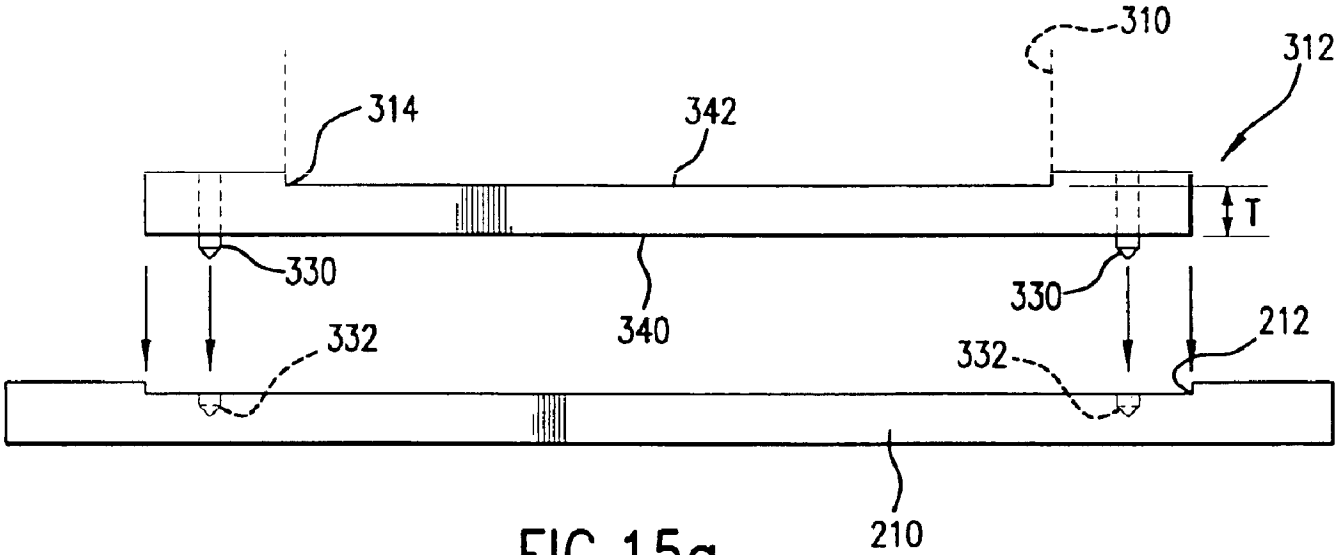
FIGS. 15*a* and 15*b* are side and top views, respectively, of the adapter plate of FIG. 14.
Figure 15B:
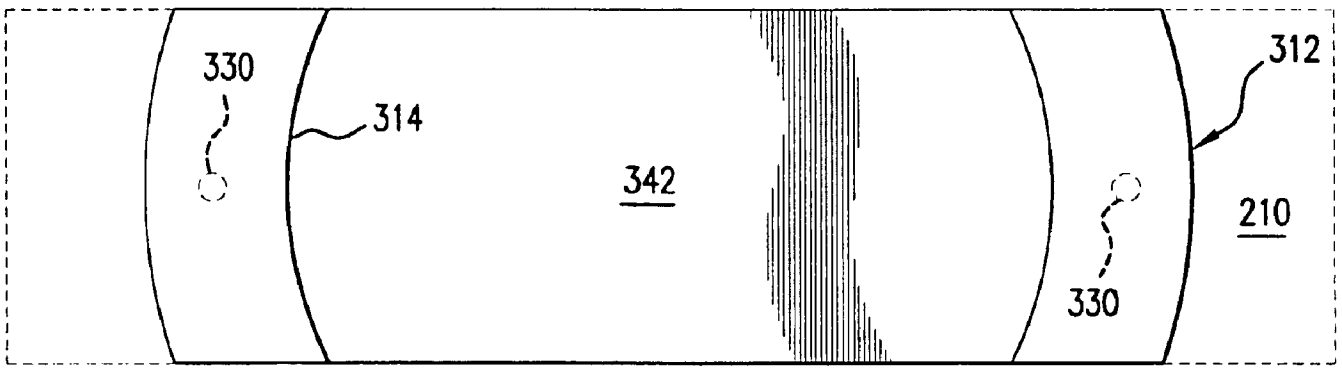

In accordance with another aspect of the present invention, the test station 200 may readily accommodate a variety of testing heads having different exterior dimensions. For example, a polishing head 310 shown in FIG. 13*a* is smaller than the polishing head 203 of FIG. 10*a*. The polishing head 310 holds 200 mm wafers for polishing whereas the polishing head 203 holds 300 mm wafers for polishing. To accommodate different sized polishing heads, the test station 200 includes an adapter plate 312 which may be placed onto the carriage plate 210 of the carriage 206 instead of a polishing head as shown in FIGS. 13*a*-14. The adapter plate 312 has a recess 314 (FIGS. 15*a* and 15*b*) which is sized to receive a different sized polishing head such as the polishing head 310 as best seen in FIG. 15*a*.

The circular-shaped outer dimensions of the adapter plate 312 are received in the recess 212 of the carriage plate 210. In addition, the adapter plate 312 has pins 330 which are received in corresponding apertures 332 of the carriage plate 210 to interlock the adapter plate 312 to the carriage plate 210. Once the adapter plate 212 has been loaded onto the carriage plate 210 and a polishing head 310 has been loaded onto the adapter plate 312, the carriage 206 may be moved to the mount position (FIG. 13*a*) to position the polishing head 310 below the head adapter 208 and the head 310 may be mounted to the adapter 208 over a test wafer 273 as shown in FIG. 14. In addition, the carriage 206 and adapter plate 312 may be withdrawn to the load/standby position as shown in FIG. 13*b*. To accommodate polishing heads for 300 mm wafers again, the adapter plate 312 may be readily removed from the carriage plate 210, thereby exposing the carriage recess 212 to receive a 300 mm type polishing head. It is appreciated that the recesses of the carriage and adapter plate may have different sizes and shapes, depending upon the particular polishing head to be tested. In addition, the thickness "T" of the adapter plate between the bottom 340 of the adapter plate and the top surface 342 of the recess 314 may be selected to accommodate the difference in height between the polishing heads such as the heads 203 and 310.

Figure 16:
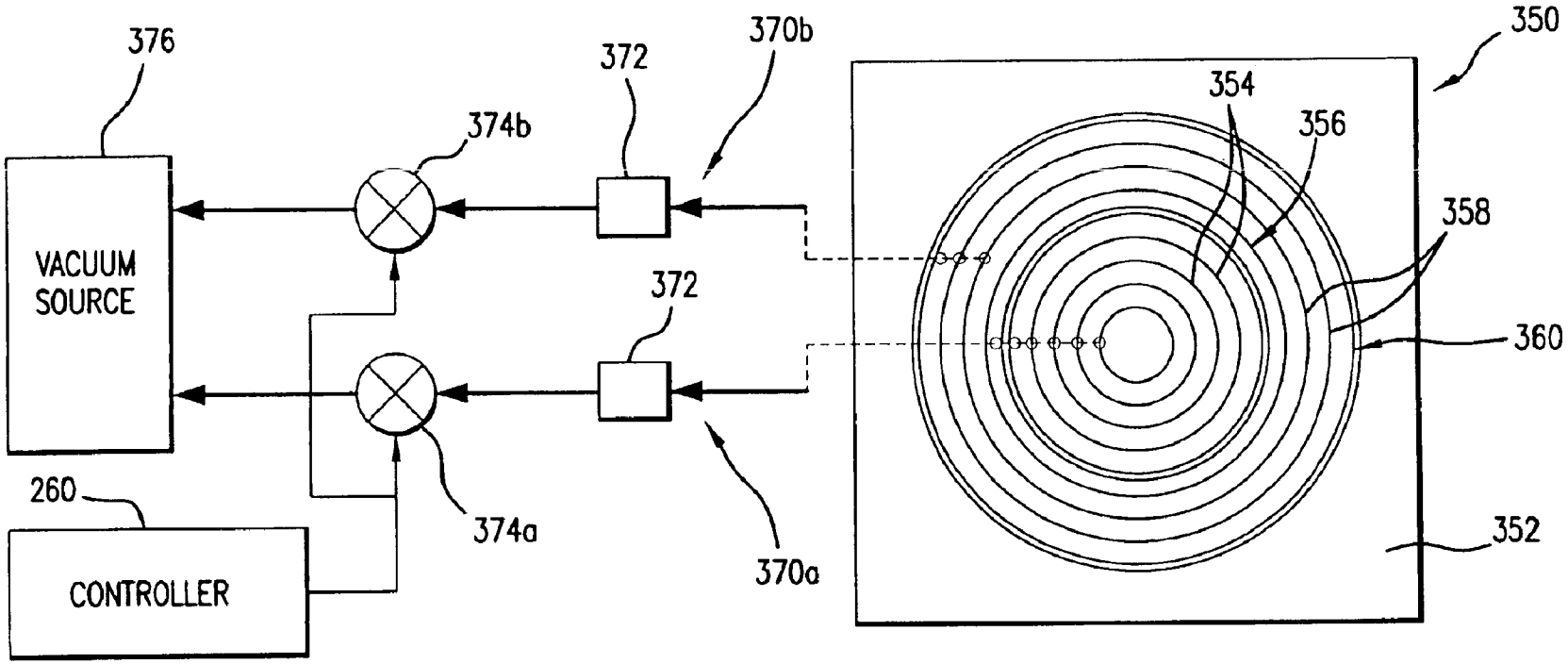
FIG. 16 is a top schematic view of the wafer chuck system of the test station of FIG. 10.
Figure 17:
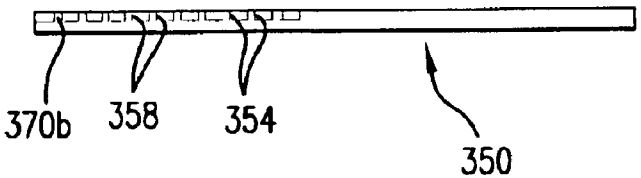
FIG. 17 is a side view of the wafer chuck of FIG. 16.

The test station 200 also includes a wafer chuck 350 which as best seen in FIG. 16 includes a plate 352 which defines a first set of annular-shaped grooves 354 in a central disk-shaped area 356, and a second set of annular-shaped grooves 358 in an annular shaped area 360 surrounding the central area 356. The wafer chuck 350 is able to accommodate test wafers of two sizes, in this example, 200 mm wafers and 300 mm wafers. The test station 200 has two independent vacuum lines 370*a* and 370*b* coupled to the first and second sets of grooves 354 and 358, respectively, which draw vacuum pressure through the grooves to draw a test wafer down and chuck the test wafer in place on the wafer chuck 350 below the head mount 208.

The vacuum line 370*a* includes a pressure regulator 372 and a control valve 374*a* which couples the vacuum line 370*a* to a common vacuum pressure source 376. The vacuum lines 370*b* similarly includes a pressure regulator 372 and a control valve 374*b* which couples the vacuum line 370*b* to the common vacuum pressure source 376. To chuck a smaller test wafer such as a 200 mm wafer, for example, the test station controller 260 opens the control valve 374*a* and closes the control valve 374*b* so that vacuum pressure is applied to the test wafer through the grooves 354 of the central area 356 covered by the test wafer but not the grooves 358 of the outer area 360 which would be left exposed by a smaller test wafer. Conversely, to chuck a larger test wafer such as 300 mm test wafer, for example, the test station controller 260 opens both the control valve 374*a* and the control valve 374*b* so that vacuum pressure is applied to the test wafer both through the grooves 354 of the central area 356 and the grooves 358 of the outer area 360 which are both covered by a larger test wafer. It is appreciated that the number, size and shapes of the grooves and areas may vary, depending upon the particular application. For example, a smaller central area with an associated vacuum line may be provided for 150 mm wafers within the central area 356. Also, apertures other than grooves may be utilized.

In the illustrated embodiment, the test station has pressure, vacuum and exhaust pneumatic circuits such as those shown in FIG. 7, for each chamber of the polishing head. In accordance with another aspect, the test station may have such pneumatic circuits for devices other than polishing heads used in the polishing of semiconductor wafers. For example, the test station have pneumatic circuits for testing F.I. pad conditioners as well as the chambers of various other polishing materials.

It will, of course, be understood that modifications of the illustrated embodiments, in their various aspects, will be apparent to those skilled in the art, some being apparent only after study, others being matters of routine mechanical and electronic design. Other embodiments are also possible, their specific designs depending upon the particular application. As such, the scope of the invention should not be limited by the particular embodiments described herein but should be defined by the appended claims and equivalents thereof.

What is claimed is:

1. A test station for testing a polishing head for planarizing a semiconductor wafer, the station comprising:

a frame having a wafer support surface adapted to support a test wafer;

a polishing head mount adapted to mount said polishing head;

a pneumatic circuit adapted to couple to said polishing head and to pressure test said head; and a controlled position actuator, coupled to said frame and said mount and adapted to move said polishing head in a vertical direction relative to said wafer support surface, and to support said polishing head at more than two vertical positions relative to said wafer support surface, each vertical position of said polishing head corresponding to a controlled position of said actuator.

2. A test station for testing a polishing head for planarizing a semiconductor wafer, the station comprising:

a frame having a wafer support surface adapted to support a test wafer;

a polishing head mount adapted to mount said polishing head;

a pneumatic circuit adapted to couple to said polishing head and to pressure test said head; and a linear actuator, coupled to said frame and said mount and adapted to move said polishing head in a plurality of steps in a vertical direction relative to said wafer support surface, and to position said polishing head at one of a plurality of vertical positions relative to said wafer support surface, each vertical position of said polishing head corresponding to a step of said linear actuator.

3. The test station of claim 2 wherein said linear actuator includes an electronically controlled motor.

4. The test station of claim 3 wherein said motor is adapted to position said mount in steps of less than 500 microns per step.

5. The test station of claim 3 wherein said motor is adapted to position said mount over a vertical displacement in excess of 60 mm.

6. The test station of claim 3 wherein said motor is a servo motor.

7. The test station of claim 3 wherein said motor is a stepping motor.

8. The test station of claim 3 wherein said linear actuator includes a guide rail and a carriage adapted to slide along said guide rail wherein said head mount is connected to said carriage.

9. A method of testing a polishing head for planarizing a semiconductor wafer, comprising:

mounting a polishing head to a polishing head mount of a test station;

controlling a controllable actuator to move said head to a controlled position over a surface of said test station to support said polishing head at more than two vertical positions relative to said surface, each vertical position of said polishing head corresponding to a controlled position of said actuator; and testing a component of said polishing head at a controlled position.

10. A method of testing a polishing head for planarizing a semiconductor wafer, comprising:

mounting a polishing head to a polishing head mount of a test station;

controlling a linear actuator to move said head a predetermined number of steps to position said polishing head at a predetermined vertical displacement over a surface of said test station; and testing a component of said polishing head at said predetermined vertical displacement.

11. The method of claim 10 wherein each of said steps is less than 500 microns.

12. The method of claim 10 wherein said testing includes testing a wafer loss sensor of the head.

13. The method of claim 12 wherein said testing includes applying vacuum pressure to a membrane chamber of said head to pick up a test wafer disposed on said surface.

14. The method of claim 13 wherein said vacuum pressure is in a range of −2 to −7 psi below ambient.

15. The method of claim 14 wherein said vacuum pressure is approximately −5 psi below ambient.

16. The method of claim 13 wherein said testing includes applying pressure to an inner tube chamber of said head prior to applying said vacuum pressure to said membrane chamber.

17. The method of claim 16 wherein said inner tube chamber is pressurized to a pressure in a range of 0–3 psi above ambient.

18. The method of claim 17 wherein said inner tube chamber pressure is approximately 1 psi above ambient.

19. The method of claim 16 wherein said testing includes monitoring the pressure in said inner tube chamber while applying said vacuum pressure to said membrane chamber.

20. A test station for testing a polishing head for planarizing a semiconductor wafer, the station comprising:

a frame having a wafer support surface adapted to support a test wafer;

a polishing head mount adapted to mount said polishing head;

a pneumatic circuit adapted to couple to said polishing head and to pressure test said head;

a carriage coupled to said frame and adapted to move said polishing head over said wafer support surface to said head mount.

21. The test station of claim 20 further comprising a pair of horizontal guide rails disposed on said frame with said wafer support surface disposed between said guide rails, said carriage being adapted for sliding movement along said guide rails.

22. The test station of claim 20 wherein said carriage includes a plate which defines a first recess sized to receive a first polishing head.

23. The test station of claim 22 further comprising an adapter plate which defines a second recess sized differently than said first recess wherein said second recess is sized to receive a second polishing head different in size than said first polishing head, said carriage plate being adapted to support said adapter plate.

24. The test station of claim 23 wherein said adapter plate is sized to be received within said first recess of said carriage plate.

25. The test station of claim 24 wherein said adapter plate has a plurality of pins and said carriage plate has a plurality of apertures sized and positioned to receive said adapter plate pins.

26. The test station of claim 20 wherein said carriage is movable between a carriage load position at which a polishing head is loaded onto said carriage, and a carriage mount position below said head mount at which a polishing head is mounted to said mount, said test station further comprising a sensor positioned to sense when the carriage is moved from the carriage load position.

27. The test station of claim 26 further comprising a vertical actuator carried by said frame for moving said head mount between a head mount position at which the polishing head is mounted onto the mount, and a head test position at which a polishing head attached to said mount is tested wherein said head mount position is higher than said head test position, said test station further comprising a controller responsive to said sensor and adapted to control said vertical actuator to raise said head mount to said head mount position when said carriage is moved from the carriage load position, and to lower said head mount to said head test position when said carriage is moved to said carriage load position.

28. The test station of claim 20 further comprising a plurality of wheels wherein said frame is supported by said wheels so that said frame may be rolled on said wheels.

29. The test station of claim 20 further comprising a second pneumatic circuit adapted to couple to another polishing device other than said polishing head and to pressure test said other polishing device.

30. A method of testing a polishing head for planarizing a semiconductor wafer, comprising:

moving a carriage supporting a polishing head to a position below a head mount on a test station;

mounting the polishing head to the head mount;

withdrawing the carriage from below the polishing head; and testing a component of the polishing head with the carriage withdrawn from below the polishing head.

31. The method of claim 30 wherein the carriage is supported by a pair of guide rails mounted on the test station.

32. The method of claim 30 further comprising sensing movement of the carriage toward the head mount; and in response to the sensed movement, lifting the head mount prior to mounting the polishing head to the head mount.

33. The method of claim 32 further comprising sensing withdrawal of the carriage from the head mount and in response to the sensed withdrawal, lowering the head mount.

34. The method of claim 33 wherein the sensing includes sensing the proximity of the carriage with an inductive sensor.

35. The method of claim 33 wherein the lifting and lowering of the head mount includes using a pneumatic cylinder to actuate the head mount.

36. The method of claim 30 further comprising, prior to moving the carriage, placing an adapter plate on the carriage and placing a polishing head on a polishing head support surface of the adapter plate.

37. The method of claim 30 further comprising, prior to moving the carriage, removing from a carriage support surface an adapter plate having a support surface for a polishing head, and placing a polishing head on the carriage support surface.

38. The method of claim 37 wherein the carriage support surface has a recess adapted to receive a polishing head of a first size and wherein the adapter plate support surface has a recess adapted to receive a polishing head of a second size different from said first size.

39. The method of claim 38 wherein the polishing head of a first size is adapted to hold a 300 mm semiconductor wafer for polishing and wherein the polishing head of a second size is adapted to hold a 200 mm semiconductor wafer for polishing.

40. The method of claim 38 wherein the carriage support surface recess is adapted to receive the adapter plate.

41. The method of claim 40 wherein the adapter plate has a plurality of pins and said carriage support surfaces defines a plurality of apertures, each aperture being positioned and sized to receive an adapter plate pin.

42. The method of claim 30 further comprising rolling the test station from a first location to a second location using wheels supporting a frame of said test station.

43. The method of claim 30 further comprising pressure testing a polishing device other than a polishing head using a pneumatic circuit of said test station.

44. A test station for testing a polishing head for planarizing a semiconductor wafer, the station comprising:

a wafer chuck having a wafer support surface adapted to support a test wafer, wherein said wafer support surface defines a first set of apertures disposed in a central area of said surface and a second set of apertures in an outer, annular shaped area of said surface surrounding said central area;

a first vacuum pressure line coupled to said first set of apertures;

a second vacuum pressure line coupled to said second set of apertures;

a polishing head mount adapted to mount said polishing head;

a pneumatic circuit adapted to couple to said polishing head and to pressure test said head; and a controller coupled to said first and second pressure lines and adapted to control said pressure lines wherein vacuum pressure is applied to said first set of apertures but not said second set of apertures to chuck a first test wafer of a first size to said central area of said chuck surface, and wherein vacuum pressure is applied to both said first set of apertures and said second set of apertures to chuck said a second test wafer of a second, larger size to both said central area and said outer area of said chuck surface.

45. The test station of claim 44 wherein said first test wafer has a diameter of 200 mm and said second test wafer has a diameter of 300 mm.

46. A method of testing a polishing head for planarizing a semiconductor wafer, comprising:

applying vacuum pressure to a wafer chuck having a first set of apertures disposed in a central area of a chucking surface below a test wafer and a second set of apertures in an outer, annular shaped area of said chucking surface surrounding said central area and said test wafer wherein vacuum pressure is applied to said first set of apertures but not said second set of apertures to chuck said test wafer to said central area of said chuck surface.

47. The method of claim 46 wherein said test wafer has a diameter of 200 mm.

48. A method of testing a polishing head for planarizing a semiconductor wafer, comprising:

applying vacuum pressure to a wafer chuck having a first set of apertures disposed in a central area of a chucking surface below a test wafer and a second set of apertures in an outer, annular shaped area of said chucking surface surrounding said central area and below said test wafer wherein vacuum pressure is applied to both said first set of apertures and said second set of apertures separately and independently to chuck said test wafer to both said central area and said outer area of said chuck surface.

49. The method of claim 48 wherein said test wafer has a diameter of 300 mm.

* * * * *